US007475768B2

(12) United States Patent
Takaoka et al.

(10) Patent No.: US 7,475,768 B2
(45) Date of Patent: Jan. 13, 2009

(54) ACCUMULATION DEVICE AND BOX PACKING SYSTEM HAVING SAME

(75) Inventors: Kazuhiro Takaoka, Ritto (JP); Seisaku Iwasa, Ritto (JP); Motoki Takayama, Ritto (JP); Yuji Yokota, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 11/855,572

(22) Filed: Sep. 14, 2007

(65) Prior Publication Data

US 2008/0066433 A1 Mar. 20, 2008

(30) Foreign Application Priority Data

Sep. 15, 2006 (JP) ..... 2006-250709
Oct. 3, 2006 (JP) ..... 2006-272077

(51) Int. Cl.
*B65G 47/24* (2006.01)

(52) U.S. Cl. ..... 198/412; 198/407; 198/413; 198/598; 271/185; 271/190

(58) Field of Classification Search ..... 198/407, 198/412, 413, 416, 457.01, 576, 598; 414/782; 271/184, 185, 190
See application file for complete search history.

(56) References Cited

U.S. PATENT DOCUMENTS 3,190,461 A * 6/1965 Postlewaite ..... 414/765
4,086,744 A * 5/1978 Seragnoli ..... 53/136.4
4,242,029 A * 12/1980 Musgrave ..... 414/413
4,264,253 A * 4/1981 Kennison ..... 414/789.5
4,487,308 A * 12/1984 Focke et al. ..... 198/412
5,364,090 A * 11/1994 Hollis et al. ..... 271/216
5,713,713 A * 2/1998 Syde et al. ..... 414/403
5,980,191 A * 11/1999 Trible ..... 414/746.7
6,149,378 A * 11/2000 Biondi et al. ..... 414/795.3
6,217,274 B1 * 4/2001 Svyatsky et al. ..... 414/405
6,427,825 B1 * 8/2002 Biagiotti ..... 198/461.2
6,648,123 B1 * 11/2003 Rustad ..... 198/400
6,817,608 B2 * 11/2004 Sloan et al. ..... 271/216
RE38,867 E * 11/2005 Kusters ..... 271/225
7,036,655 B2 * 5/2006 Schafer ..... 198/459.2
7,175,017 B2 * 2/2007 Carey et al. ..... 198/412
7,210,280 B2 * 5/2007 Cottone et al. ..... 53/530

FOREIGN PATENT DOCUMENTS

JP H05-262304 A 10/1993
JP 2004-155428 A 6/2004
JP 2005-119723 A 5/2005

* cited by examiner

*Primary Examiner*—Douglas A Hess
(74) *Attorney, Agent, or Firm*—Global IP Counselors, LLP

(57) ABSTRACT

An accumulation device is adapted to accumulate a plurality of products according to at least one prescribed accumulation pattern. The accumulation device includes a receiving unit, a first accumulation processing unit, a second accumulation processing unit and a discharge unit. The first accumulation processing unit is configured and arranged to perform a first accumulation processing to a first group of the products received in the receiving unit. The second accumulation processing unit is disposed parallel to the first accumulation processing unit with respect to the receiving unit, and configured and arranged to perform a second accumulation processing to a second group of the products received in the receiving unit. The second accumulation processing is different from the first accumulation processing. The discharge unit is configured and arranged to transfer the products processed in the first and second accumulation processing units toward a downstream portion.

7 Claims, 25 Drawing Sheets

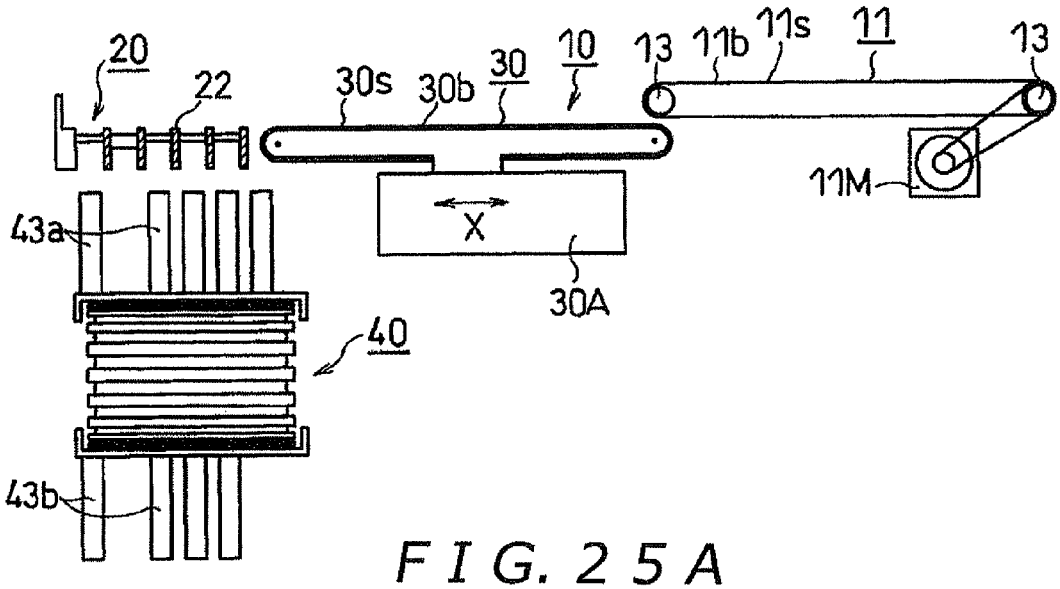
FIG. 25A
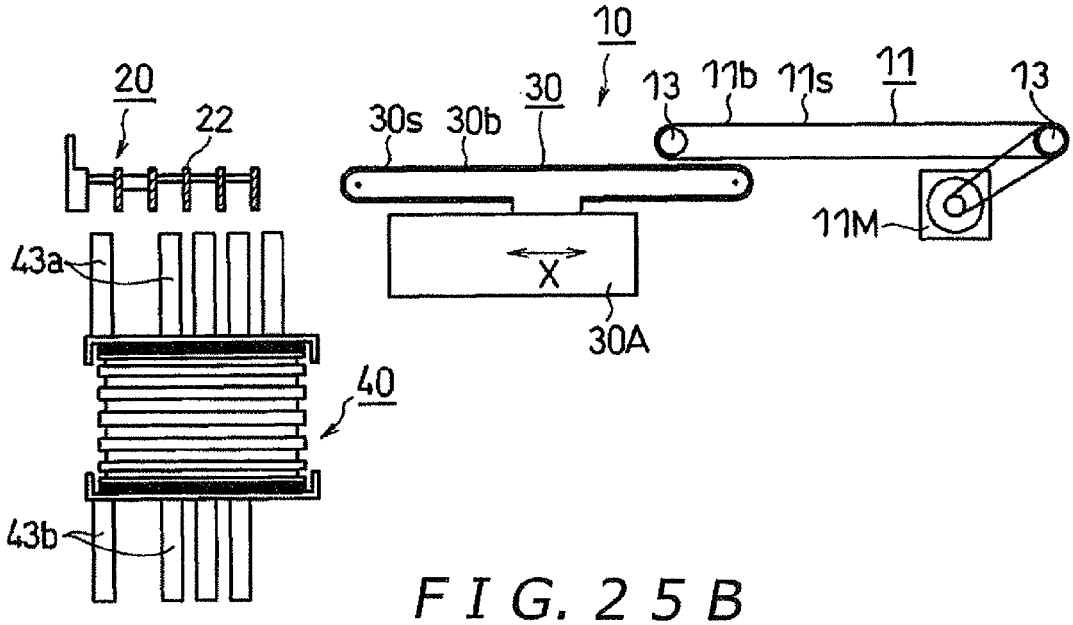
FIG. 25B
| | LARGE | MEDIUM | SMALL |
|---|---|---|---|
| COUNTER NUMBER OF ENCODER | $\alpha$ | $\beta$ | $\gamma$ |
FIG. 25C

ACCUMULATION DEVICE AND BOX PACKING SYSTEM HAVING SAME

CROSS-REFERENCE TO RELATED APPLICATIONS

This application claims priority to Japanese Patent Application No. 2006-250709 filed on Sep. 15, 2006 and No. 2006-272077, filed on Oct. 3, 2006. The entire disclosures of Japanese Patent Application Nos. 2006-250709 and 2006-272077 are hereby incorporated herein by reference.

BACKGROUND OF THE INVENTION

1. Field of the Invention

The present invention relates to accumulating and box packing of a product. More specifically, the present invention relates to an accumulation device for accumulating (stacking) a plurality of packaged confections or other products according to at least one prescribed accumulation pattern, and to a box packing system that is provided with the accumulation device.

2. Background Information

Checking devices, accumulation devices, box packing devices, and the like are currently used in production lines that include a combination weighing device or a bag manufacturing and packaging machine. Examples of checking devices include seal checkers that check for defects in the sealed portion of a confection bag or the like, weight checkers for verifying whether the weight of a product is within a prescribed range, and other checkers. An accumulation device arranges a plurality of bags of normal products, whose checking is completed, into a prescribed pattern. A box packing system packs a bundle of a plurality of accumulated bags into a cardboard box.

For example, Japanese Laid-Open Patent Application Publication No. 2004-155428 (published on Jun. 3, 2004) discloses a box packing system for packing bundles of a plurality of packaged products into a box at high speed from the horizontal direction in multiple levels, wherein the products are accumulated so as to stand sideways on a conveyor device. Also, Japanese Laid-Open Patent Application Publication No. H05-262304 discloses a box packing device that includes a belt conveyor having a convening surface that is selectively extendable in a conveying direction. Furthermore, Japanese Laid-Open Patent Application Publication No. 2005-119723 discloses a box packing system that is provided with a guide mechanism that is arranged to adjust a position or posture of the packaged products as the packaged products are transported on the conveyor.

In view of the above, it will be apparent to those skilled in the art from this disclosure that there exists a need for an improved accumulation device and box packing system. This invention addresses this need in the art as well as other needs, which will become apparent to those skilled in the art from this disclosure.

SUMMARY OF THE INVENTION

The conventional accumulation devices described above have some drawbacks as follows. Specifically, the conventional accumulation device disclosed in Japanese Laid-Open Patent Application Publication No. 2004-155428 is configured so that the packaged products can be accumulated only in a prescribed accumulation pattern in which the products are in a prescribed sideway standing-up position between substantially L-shaped brackets that move along the conveying surface of the conveyor device. The accumulation pattern and the size of the products that can be accumulated using such conventional accumulation device are therefore limited. Thus, the accumulation process for implementing a plurality of accumulation patterns is difficult to perform in a single device when products of different sizes are accumulated, or the products are accumulated in varying orientations, for example. As a result, products and the like having different sizes or accumulation directions cannot be processed in a box packing system or the like that is disposed downstream of the accumulation device, and box packing therefore needs to be performed manually.

It has been proposed to provide an orientation changing unit to an accumulation device, in which a plurality of delivery platforms is provided to a rotating support plate. The orientation changing unit is arranged to rotate a product fed from a conveyor along with a delivery platform so as to change the orientation of the product. However, in such accumulation device, the position of the distal end of the conveyor in the conveyance direction is set so that a product is transferred completely onto the delivery platform, and the product does not come in contact with the conveyor. However, the products also made in a variety of sizes. If the distal end position of the conveyor is set for a large-sized product, then the distance of the space between the conveyor and the delivery platform will be too large when a small-sized product is transported from the conveyor to the delivery platform. In such case, the orientations of the products being conveyed become inconsistent. There is also a risk of damaging the package contents as a result of inconsistent orientation. Furthermore, the ability to transport the products can also be reduced, and the cycle time can increase.

The present invention was conceived in view of the foregoing drawbacks. One object of the present invention is to provide an accumulation device capable of efficiently accumulating or stacking the packaged products according to a plurality of accumulation patterns in a single accumulation device, and to provide a box packing system that is provided with the accumulation device.

Another object of the present invention is to provide an accumulation device capable of transferring a product to an orientation changing unit regardless of the size of the product and without the orientation of the product becoming inconsistent, and of transferring the product to the orientation changing unit in a prescribed cycle time without damaging the package contents, by varying the length of a conveyor according to the size of the product.

In order to achieve the above objects of the present invention, the accumulation device according to a first aspect of the present invention is adapted to accumulate a plurality of products according to at least one prescribed accumulation pattern. The accumulation device includes a receiving unit, a first accumulation processing unit, a second accumulation processing unit and a discharge unit. The receiving unit is configured and arranged to receive the products. The first accumulation processing unit is configured and arranged to perform a first accumulation processing to a first group of the products that are received in the receiving unit. The second accumulation processing unit is disposed parallel to the first accumulation processing unit with respect to the receiving unit, and configured and arranged to perform a second accumulation processing to a second group of the products that are received in the receiving unit. The second accumulation processing is different from the first accumulation processing. The discharge unit is configured and arranged to transfer the products processed in the first and second accumulation processing units toward a downstream portion.

In this arrangement, the products that have been received in the same receiving unit are processed in parallel in two accumulation processing units (the first accumulation processing unit and the second accumulation processing unit) that are disposed parallel to each other, after which the accumulated products are transferred from the same discharge unit to, for example, a box packing system or other device that is disposed downstream of the discharge unit.

The first and second accumulation processing in the first accumulation processing unit and the second accumulation processing unit includes, for example, processing for accumulating while aligning the plurality of products, and/or processing for only varying the orientation of a single product.

Usually, bundles of the plurality of products are formed according to a specific accumulation pattern in an accumulation device that accumulates the plurality of products in a prescribed accumulation pattern in this manner and transfers the products to a downstream box packing system or the like. Therefore, in such cases as when products having multiple shapes are packed into a single box, or the orientations of identical products are varied in box packing, the irregular products, irregularly oriented products, or the like must be manually packed, which is troublesome.

In the accumulation device according to the first aspect of the present invention, two accumulation processing units that are disposed parallel to each other are provided between a shared receiving unit and discharge unit. Thus, according to the accumulation device of the first aspect, even when products of different sizes are received, or the same product is accumulated in different orientations, these products can be processed in parallel with normal accumulation processing. As a result, a plurality of products can be accumulated according to a plurality of accumulation patterns in a single accumulation device without reducing the processing efficiency.

The accumulation device according to a second aspect of the present invention is the accumulation device according to the first aspect, wherein the first accumulation processing unit and the second accumulation processing unit are aligned with respect to each other in a vertical direction.

In this arrangement, the two accumulation processing units that are disposed parallel to each other are disposed to be aligned vertically in the accumulation device. Thus, according to the accumulation device of the second aspect, the plurality of products can be efficiently accumulated in accordance with a plurality of accumulation patterns without increasing the size of the device footprint.

The accumulation device according to a third aspect of the present invention is the accumulation device of the first aspect, wherein the first accumulation processing unit has a transport mechanism configured and arranged to accumulate the first group of the products, and a transfer mechanism configured and arranged to transfer the first group of the products one at a time from the receiving unit onto the transport conveyor.

In this arrangement, the transport mechanism for accumulating and arranging a plurality of products, and the transfer mechanism (e.g., a transfer platform, a paddle or the like) for lining up the products one at a time on the transport mechanism are used as the first accumulation processing unit. Thus, according to the accumulation device of the third aspect, a prescribed arrangement pattern can be formed by transferring the products received in the receiving unit onto the transport mechanism one product at a time.

The accumulation device according to a fourth aspect of the present invention is the accumulation device according to the first aspect, wherein the second accumulation processing unit has a vacuum transport mechanism configured and arranged to apply suction to the second group of the products to transport the second group of the products.

In this arrangement, the vacuum transport mechanism capable of vacuum-transporting the product is used as the second accumulation processing unit. Thus, according to the accumulation device of the fourth aspect, even in such cases as when a product is handled that has a different size than a product processed in the first accumulation processing unit, or the orientation of a product needs to be varied with respect to that of normal accumulation, the product can be accumulated in a different accumulation pattern than that of the first accumulation processing unit.

The accumulation device according to a fifth aspect of the present invention is the accumulation device according to the first aspect, wherein the first accumulation processing unit is configured and arranged to perform the first accumulation processing of the first group of the products concurrently with the second accumulation processing of the second group of the products by the second accumulation processing unit.

In this arrangement, even when a plurality of products that is transported from the same receiving unit is accumulated according to different accumulation patterns, the accumulation of the products can be performed simultaneously in parallel fashion. Thus, according to the accumulation device of the fifth aspect, the first and second accumulation processing by the first and second accumulation processing units can be performed automatically and simultaneously for irregular products as well without increasing the time required for accumulation processing.

The accumulation device according to a sixth aspect of the present invention is the accumulation device according to the first aspect, wherein the first accumulation processing unit is configured and arranged to accumulate the first group of the products with a main surface of each of the first group of the products being oriented substantially vertically, and the second accumulation processing unit is configured and arranged to accumulate the second group of the products with a main surface of each of the second group of the products being oriented substantially horizontally.

According to the accumulation device of the sixth aspect, in the first accumulation processing unit, a normal accumulation state, in which the products are oriented vertically, is formed and box-packing processing is performed. On the other hand, in the second accumulation processing unit, products that are lying flat that have been accumulated in the second accumulation processing unit can be box-packed in, for example, a gap between the internal wall of the box and the plurality of products that is box-packed after being accumulated in the first accumulation processing unit. As a result, an accumulation device can be provided that can adapt to various box-packing patterns.

The accumulation device according to a seventh aspect of the present invention is the accumulation device according to the first aspect, further including a lift mechanism configured and arranged to transport a bundle of at least one of the first and second groups of the products for which the first and second accumulation processing have been performed, respectively, to the discharge unit.

In this arrangement, the lift mechanism is used as the transport unit for transporting a bundle of a plurality of products that is accumulated in separate accumulation patterns in two accumulation processing units to a shared discharge unit position. Thus, according to the accumulation device of the seventh aspect, after the products, which are transported in from the shared receiving unit, are accumulated according to different accumulation patterns, the bundle of accumulated products is moved to the discharge unit using the lift mechanism, whereby the bundle of products accumulated according to a prescribed accumulation pattern is discharged downstream from the shared discharge unit.

The accumulation device according to an eighth aspect of the present invention is the accumulation device according to the first aspect wherein the receiving unit is configured and arranged to receive the products that are packaged in a flexible packaging material.

In this arrangement, the flexible packaging is used as the products that are accumulated according to a prescribed accumulation pattern. Thus, according to the accumulation device of the eighth aspect, even in the case of accumulating packaged confections and other flexible packaging in which a plurality of products is difficult to accumulate in a perfectly aligned state compared to, for example, box-shaped products, the products can be accumulated according to a prescribed accumulation pattern in the first accumulation processing unit and the second accumulation processing unit.

A box packing system according to a ninth aspect of the present invention includes the accumulation device according to the first aspect, and a packing unit configured and arranged to move a bundle of a prescribed number of the products that are aligned in the accumulation device into a box.

According to the box packing system of the ninth aspect, even when products of different sizes are received, or the same product is accumulated in different orientations, for example, these products can be processed in parallel with normal accumulation processing. As a result, a plurality of products can be accumulated according to a plurality of accumulation patterns in a single accumulation device, and the products can then be efficiently box-packed by the packing unit without reducing the processing efficiency.

An accumulation device according to a tenth aspect of the present invention is adapted to generate a bundle of a plurality of aligned products while transporting the products with each of the products having a pair of main surfaces and at least one connecting bottom part that connects the main surfaces. The accumulation device includes a conveying unit, an orientation changing unit and an aligning unit. The conveying unit has a transport surface configured and arranged to transport the products in a first direction while each of the products is oriented in a horizontal orientation so that one of the main surfaces is supported on the transport surface. The orientation changing unit is configured and arranged to receive the products from the conveying unit and to change an orientation of the products from the horizontal orientation to an upright orientation in which the main surfaces are aligned with the first direction and a vertical direction. The aligning unit is configured and arranged to accumulate the products in the upright orientation in a second direction that is perpendicular to the first direction so that the products are stacked with the main surfaces of an adjacent pair of the products being contacting each other. The conveying unit is configured and arranged to selectively extend and retract in the first direction to change a distance between the conveying unit and the orientation changing unit according to a length of each of the products in the first direction.

According to the accumulation device of the tenth aspect, by varying the length of the conveying unit according to the size of the products, the products can be transferred to the orientation changing unit without the orientation of the products becoming inconsistent, and the products can be transferred to the orientation changing unit in a prescribed cycle time without damaging the product contents regardless of the size of the products. In order to selectively extend the conveying unit in the first direction, the length of a single conveyor can be extended. Alternatively, the conveying unit can include a plurality of conveyors, and the length of the entire conveying unit can be extended in the first direction by changing an overlap range of the two or more conveyors to extend.

The accumulation device according to an eleventh aspect of the present invention is the accumulation device according to the tenth aspect, wherein the conveying unit is configured and arranged to selectively extend so that a distal end of the conveying unit approaches the orientation changing unit when the length of each of the products is short, and the conveying unit is configured and arranged to selectively retract so that the distal end of the conveying unit is spaced apart from the orientation changing unit when the length of each of the products is long.

According to the accumulation device of the eleventh aspect, in the case of product with a short length, the space distance between the conveying unit and the orientation changing unit decreases, and the products are therefore stably transferred from the conveying unit to the orientation changing unit. In the case of a product with a long length, the space distance between the conveying unit and the orientation changing unit is large, and there is therefore no interference between the products and the conveying unit when the orientation of the products that have been transferred onto the orientation changing unit is changed.

The accumulation device according to a twelfth aspect of the present invention is the accumulation device according to the eleventh aspect, wherein the conveying unit is configured and arranged to selectively extend and retract so that a position of the distal end of the conveying unit is changed according to a size of a bag of each of the products.

According to the accumulation device of the twelfth aspect, the position of the distal end of the conveying unit can be changed according to the bag size, and stability of operation and other effects can therefore be anticipated by receiving a size signal from an upstream packaging device or main control device even when the length of the products is not detected.

The accumulation device according to a thirteenth aspect of the present invention is the accumulation device according to the tenth aspect, wherein the conveying unit includes an annular conveyor belt, a first moving roller, a first fixed roller, a second moving roller and a second fixed roller. The annular conveyor belt forms the transport surface. The first moving roller is in contact with an internal peripheral surface of the conveyor belt, and is disposed at a downstream end portion of the conveying unit in the first direction. The first fixed roller is in contact with the internal peripheral surface of the conveyor belt, and is disposed at the downstream end portion of the conveying unit in the first direction. The second moving roller is in contact with an external peripheral surface of the conveyor belt, and is disposed between the first moving roller and the first fixed roller. The second fixed roller is in contact with the internal peripheral surface of the conveyor belt, and is disposed at an upstream end portion of the conveying unit in the first direction.

According to the accumulation device of the thirteenth aspect, the first moving roller also shifts upstream when the second moving roller is shifted upstream. When the second moving roller is shifted downstream, the first moving roller also shifts downstream. The conveying unit thereby extends. In this case, the surface of the conveyor belt for transporting the products is continuous, and significant level differences and the like do not occur. The products are therefore smoothly transported.

The accumulation device according to a fourteenth aspect of the present invention is the accumulation device according to the tenth aspect, wherein the orientation changing unit includes a support plate and at least one transfer platform. The support plate is configured and arranged to rotate about a first rotational axis that extends along the first direction. The transfer platform is parallel to the first rotational axis on the support plate, the transfer platform being configured and arranged to receive the products in the horizontal orientation and to change the orientation of the products to the upright orientation by rotating about the second rotational axis.

According to the accumulation device of the fourteenth aspect, the orientation can be changed while the transport direction is varied.

The accumulation device according to a fifteenth aspect of the present invention is the accumulation device according to the tenth aspect, wherein the aligning unit includes a support surface, a dividing panel and a back panel. The support surface is configured and arranged to support the bottom parts of the products. The dividing panel is configured and arranged to contact with one of the main surfaces of one of the products disposed at a leading end of a row of the products. The back panel is configured and arranged to contact with one of the main surfaces of one of the products disposed at a trailing end of the row of the products.

According to the accumulation device of the fifteenth aspect, the products can be held in alignment between the dividing panel and the back panel.

The accumulation device according to a sixteenth aspect of the present invention is the accumulation device according to the fourteenth aspect, wherein the conveying unit is configured and arranged to be placed in an extended state when the products are transferred to the transfer platform and in a retracted state while the orientation of the products are changed.

According to the accumulation device of the sixteenth aspect, there is no risk of interference between the products and the conveying unit when the orientation of products that are transferred onto the orientation changing unit is changed.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure:

FIG. 25A is a schematic side elevational view of an accumulation device according to a first modified example of the second embodiment of the present invention;

FIG. 25B is a schematic side elevational view of an accumulation device according to a second modified example of the second embodiment of the present invention; and FIG. 25C is a diagram illustrating an example of a table content stored in a rotation angle storage unit of a motor of the transport device in accordance with the second embodiment of the present invention.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Referring first to FIGS. 1 through 10, a box packing system 101 (e.g., case packer) having an accumulation device in accordance with a first embodiment of the present invention will be explained.

Overall Structure of Box Packing System 101

Figure 1:
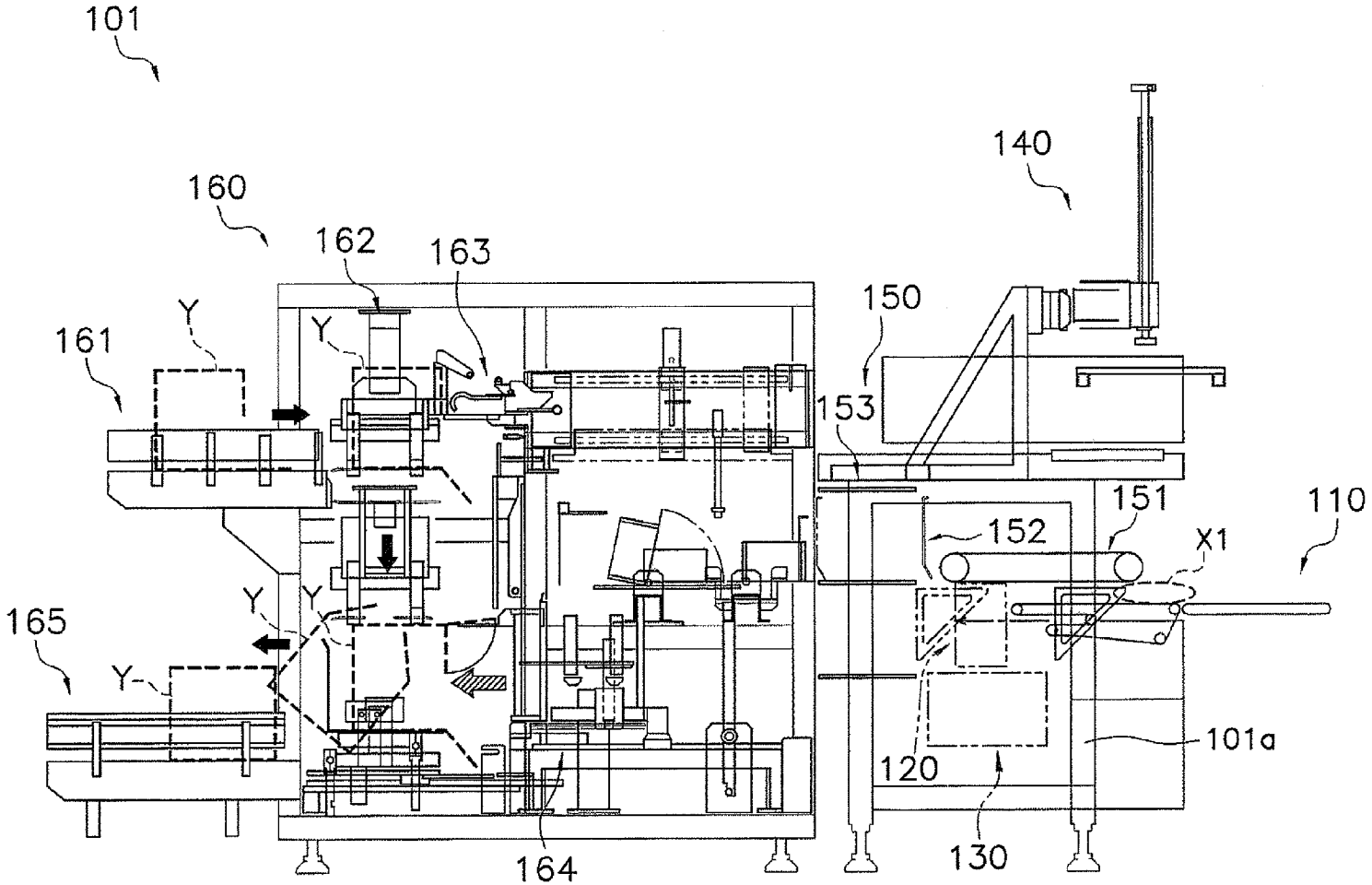
FIG. 1 is an overall front elevational view of a box packing system having an accumulation device in accordance with a first embodiment of the present invention.
Figure 2:
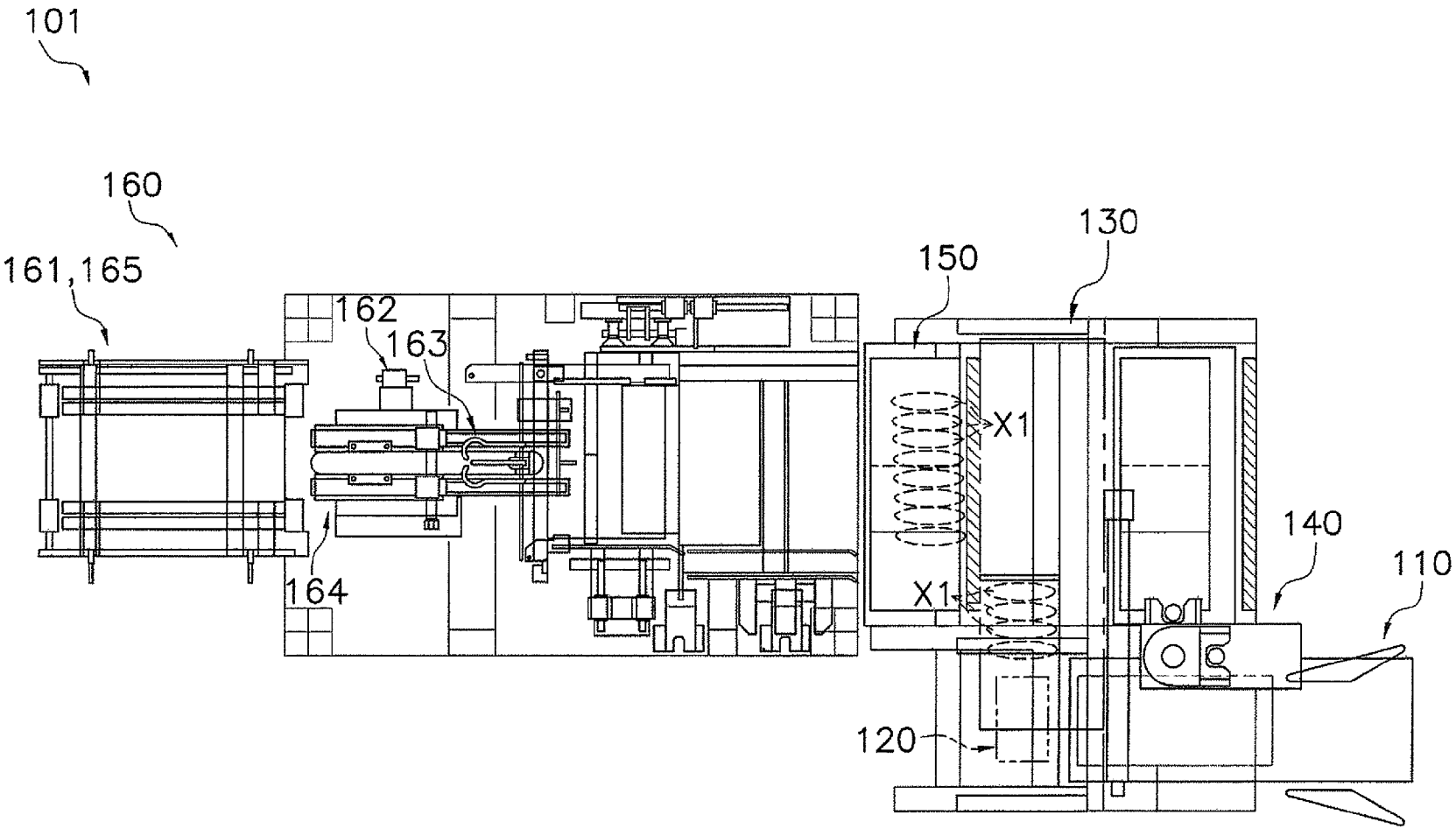
FIG. 2 is a top plan view of the box packing system illustrated in FIG. 1 in accordance with the first embodiment of the present invention.

The box packing system 101 according to the first embodiment is a device for transporting products (e.g., products in the flexible packaging) X1, X2, which are substantially rectangular packaged confections obtained by wrapping, for example, snack confections in flexible packaging, and packing the products X1, X2 into a cardboard box Y, as shown in FIGS. 1 and 2. The box packing system 101 is provided with a conveying device 110 (receiving unit), an orientation change mechanism 120, a transport mechanism 130, a vacuum transport mechanism 140, a discharge device 150 (discharge unit), and a flap opening device 160. In the first embodiment of the present invention, the accumulation device includes the conveying device 110, the orientation change mechanism 120, the transport mechanism 130, the vacuum transport mechanism 140 and the discharge device 150. Moreover, the orientation change mechanism 120 (example of a transfer mechanism) and the transport mechanism 130 preferably constitute at least a part of a first accumulation processing unit of the accumulation device, and the vacuum transport mechanism 140 preferably constitutes at least a part of a second accumulation processing unit of the accumulation device.

In this example, the product X1 is a regular-size packaged confection for box packing, and the product X2 is a service-pack packaged confection having a larger size than the product X1.

Structure of Conveying Device 110

The conveying device 110 is a transport conveyor that is disposed in an upstream portion of the box packing system 101, and that transports the products X1, X2 being transported from an upstream conveyor along a sequential transport direction "a" (see FIG. 5) to the orientation change mechanism 120 that is disposed downstream, as shown in FIGS. 1 and 2.

The products X1, X2 transported in the conveying device 110 are transported in an orientation in which the products lie flat (e.g., the main surfaces of the products X1, X2 are supported on an transport surface of the conveying device 10).

Structure of Orientation Change Mechanism 120

Figure 3:
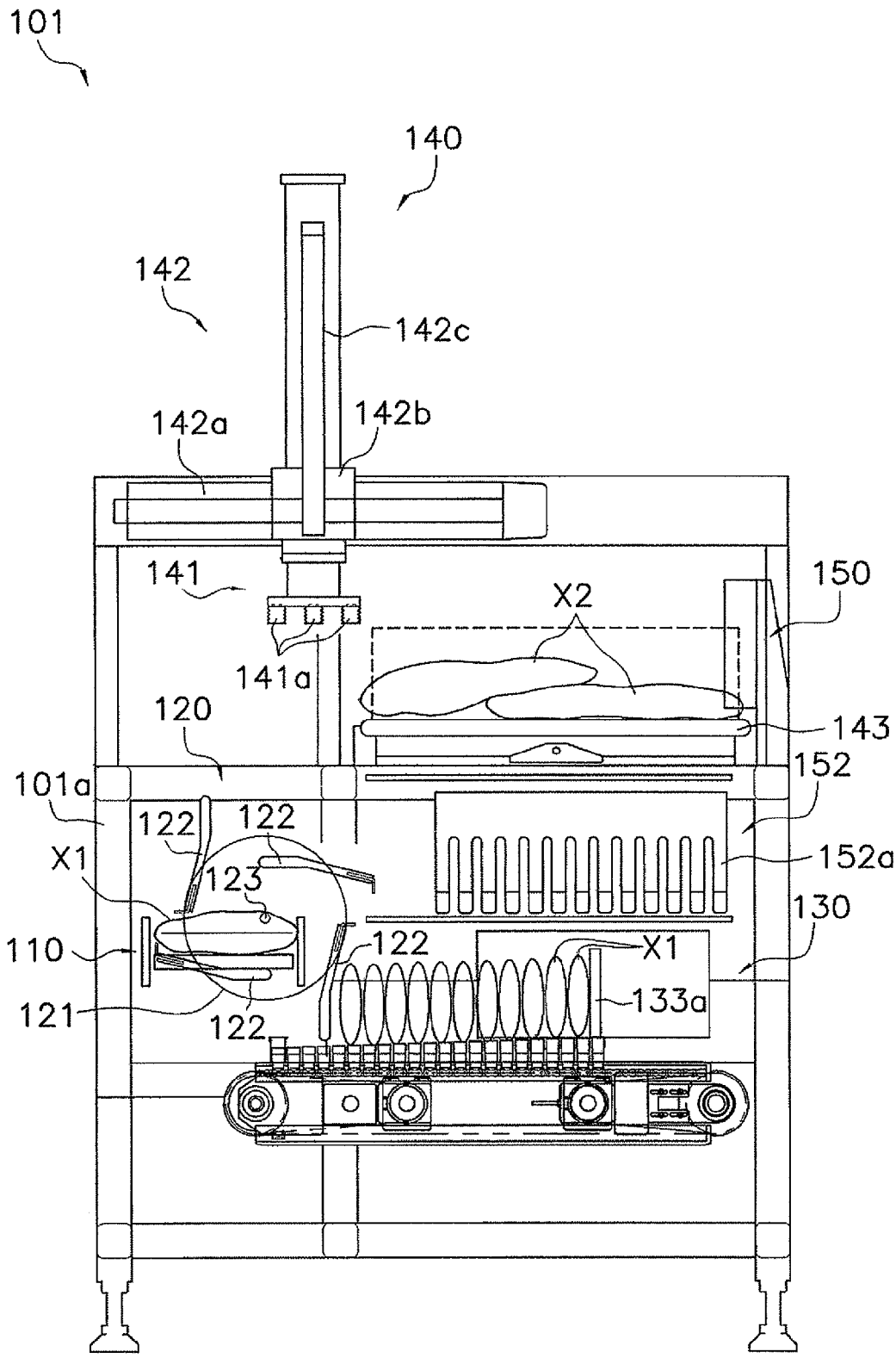
FIG. 3 is an upstream side elevational view of an accumulation device of the box packing system illustrated in FIG. 1 as viewed from a side of a conveying device of the box packing system in accordance with the first embodiment of the present invention.
Figure 5:
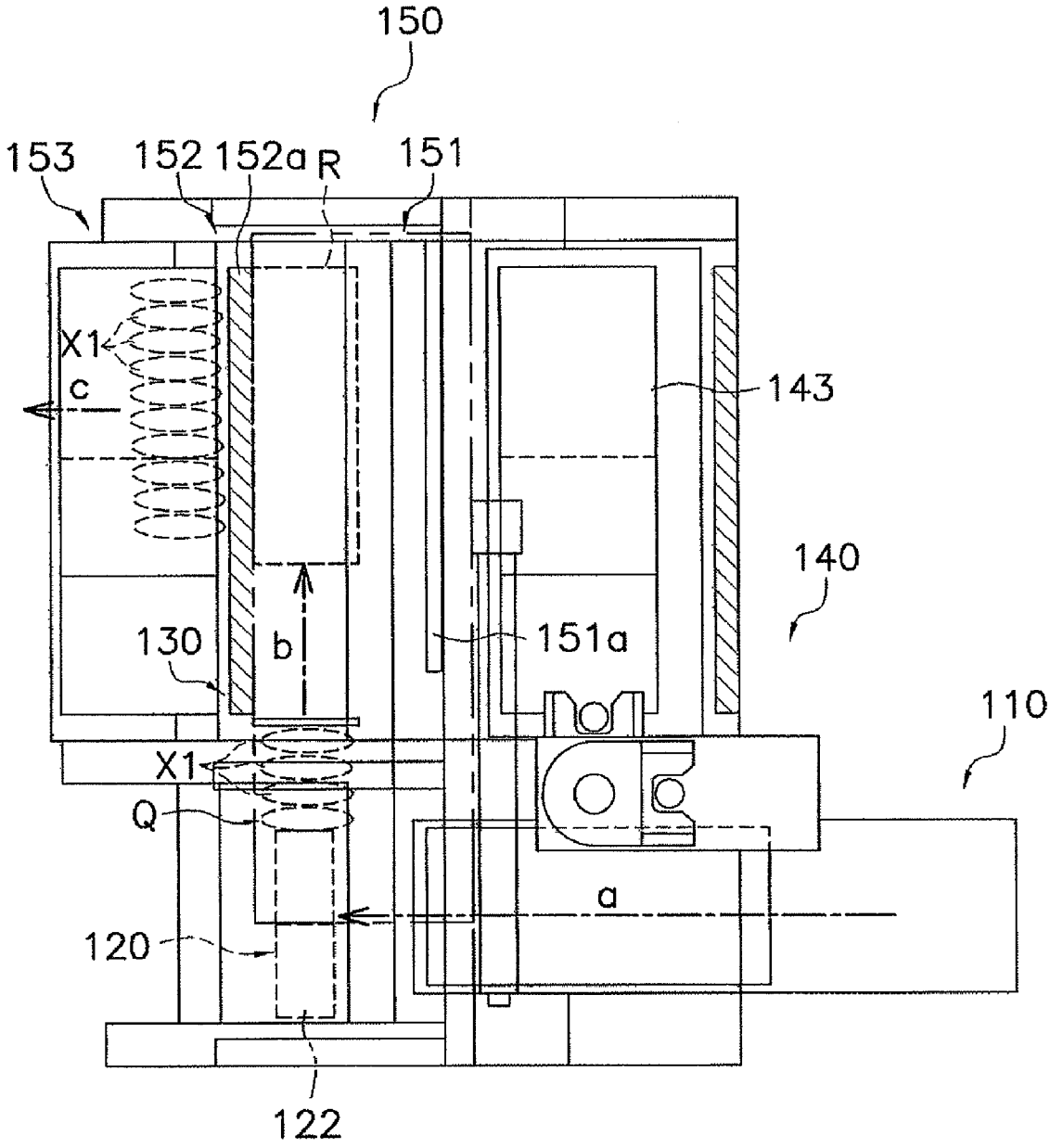
FIG. 5 is a top plan view of the accumulation device illustrated in FIGS. 3 and 4 in accordance with the first embodiment of the present invention.
Figure 7:
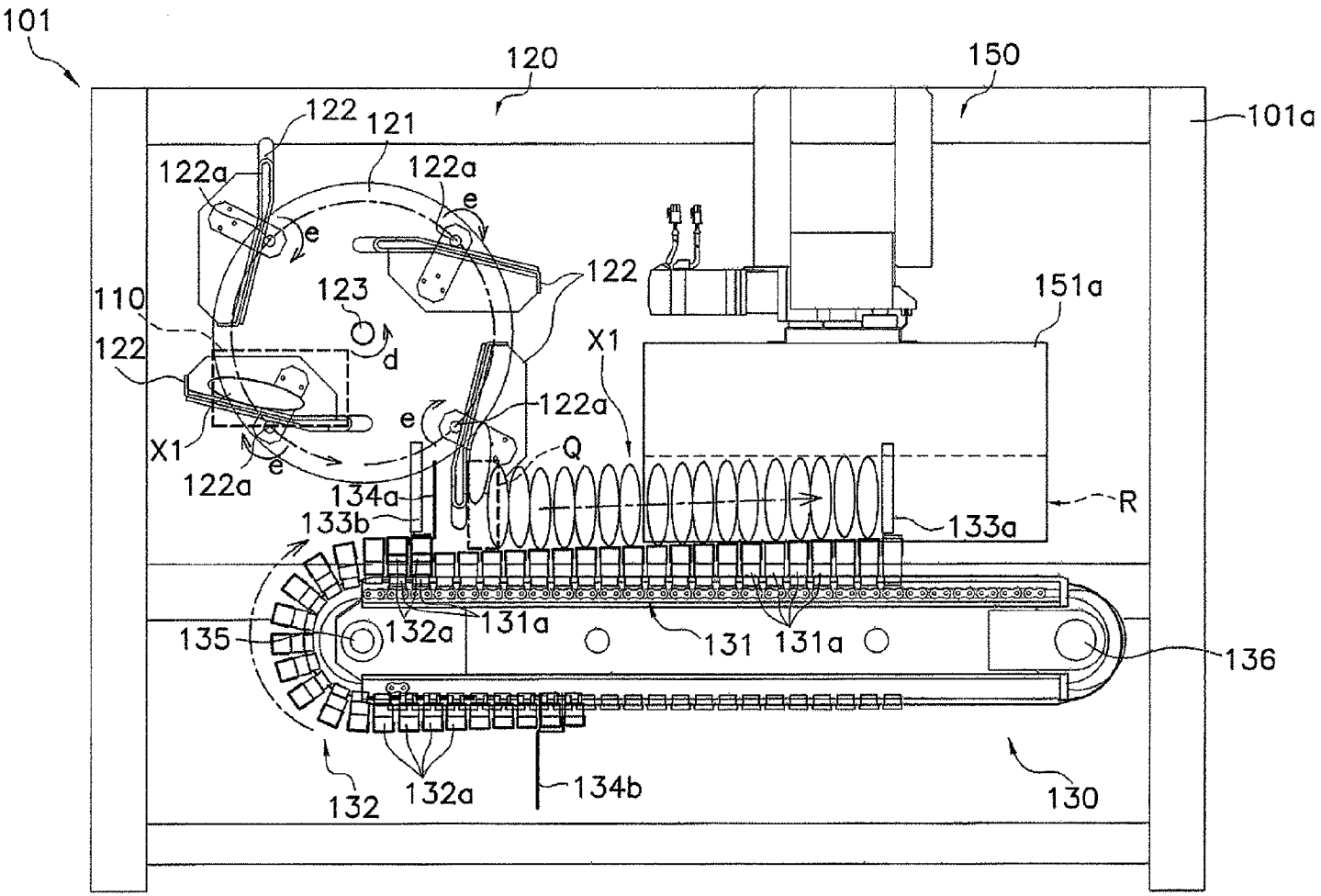
FIG. 7 is an enlarged partial upstream side elevational view of t of the accumulation device illustrated in FIGS. 3 to 5 showing the structure of an orientation change mechanism and a transport mechanism in accordance with the first embodiment of the present invention.

The orientation change mechanism 120 is disposed directly downstream of the conveying device 110, and the orientation change mechanism 120 receives the products X1 that are transported downstream along the transport direction "a" (see FIG. 5) from the upstream conveying device 110, and sequentially arranges the bags in an upright orientation in a prescribed position Q (see FIGS. 5 and 7). As shown in FIGS. 3 and 7, the orientation change mechanism 120 also has a support plate 121, four transfer platforms 122, and a first rotation shaft 123 (first rotational axis).

As shown in FIG. 3, the support plate 121 is a substantially circular plate that is supported by the first rotation shaft 123 so as to be able to rotate, and is attached to the lateral surface part of a body case 101*a* so as to substantially face the transport direction "a" downstream of the conveying device 110.

The four transfer platforms 122 are each arranged on the same circle with respect to the surface of the substantially circular support plate 121 directly downstream of the conveying device 110, and each transfer platform 122 has a mounting surface that is partially comb-tooth-shaped. The operation of the transfer platforms 122 will be described in detail in a subsequent section.

The first rotation shaft 123 is attached to the center portion of the substantially circular support plate 121, and is the center of the rotational path of the four transfer platforms 122.

Operation of Transfer Platforms 122

Figure 8:
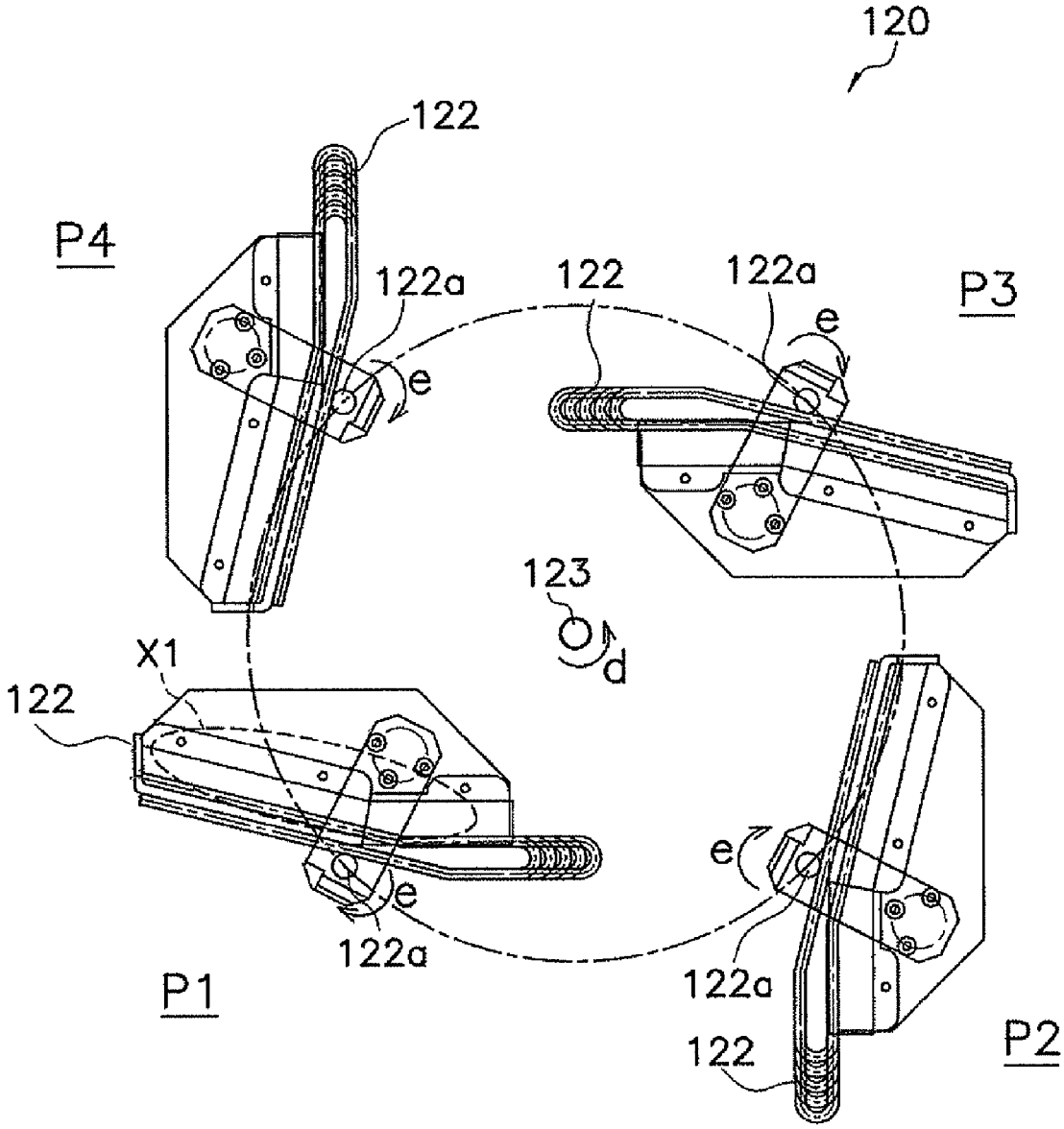
FIG. 8 is an enlarged partial upstream side elevational view of the orientation change mechanism illustrated in FIG. 7 showing the structure of a plurality of transport platforms and other components that are included in the orientation change mechanism in accordance with the first embodiment of the present invention.

The transfer platforms 122 rotate about the first rotation shaft 123 in conjunction with the rotation of the support plate 121, and receive the products X1 that are transported from the conveying device 110 on the upstream side in a state in which the longitudinal direction of the transfer platforms 122 is substantially horizontal in the position P1 shown in FIG. 8.

The support plate 121 then rotates approximately 90° in the rotation direction "d" about the first rotation shaft 123 as shown in FIG. 8. During this rotation, the transfer platforms 122 rotate in the rotation direction "e" approximately 90° about the second rotation shafts 122*a* so that the products X1 are in an upright orientation, and the transfer platforms 122 move toward the position P2 shown in FIG. 8. After the products X1 are placed in an upright orientation in the prescribed position Q in the transport mechanism 130, the transfer platforms 122 move so as to retreat upward while rotating about the first rotation shaft 123 without touching the products X1. At this time, one of the buckets 131, 132 (described in detail hereinafter) of the transport mechanism 130 is stopped in the abovementioned prescribed position Q where the products X1 are received in the upright orientation and aligned while being intermittently transported in the prescribed direction.

Furthermore, while the support plate 121 rotates about the first rotation shaft 123 approximately 90° in the rotation direction "d" from the position P2 shown in FIG. 8, the transfer platforms 122 rotate approximately 90° in the rotation direction "e" about the second rotation shafts 122*a*, and the transfer platforms 122 move to the position P3 shown in FIG. 8. In the same manner, the transfer platforms 122 move from the position P3 to the position P4 in the rotation direction "e" about the second rotation shafts 122*a*.

In the first embodiment, the four transfer platforms 122 disposed on the side surface of the support plate 121 sequentially perform the type of operation described above about the second rotation shafts 122*a*, whereby a plurality of products X1 can be transferred to the prescribed position Q in an upright orientation, to form a bundle of the products X1.

Although not illustrated in FIG. 8 in the first embodiment, a suction device can be provided to the orientation change mechanism 120 for applying suction to the products X1 loaded on the transfer platforms 122 so as to draw the products X1 to the transfer platforms 122 (as explained in detail in the second embodiment below).

Structure of Transport Mechanism 130

As shown in FIGS. 1 through 5, the transport mechanism 130 is disposed directly downstream of the orientation change mechanism 120 and directly upstream of the discharge device 150, and accumulates a prescribed number of products X1 in the upright orientation that have been transferred in the same orientation from the orientation change mechanism 120 in the prescribed position Q (see FIGS. 5 and 7) while transporting the bundle in the transport direction "b" (see FIG. 5) to a discharge position R.

Figure 6B:
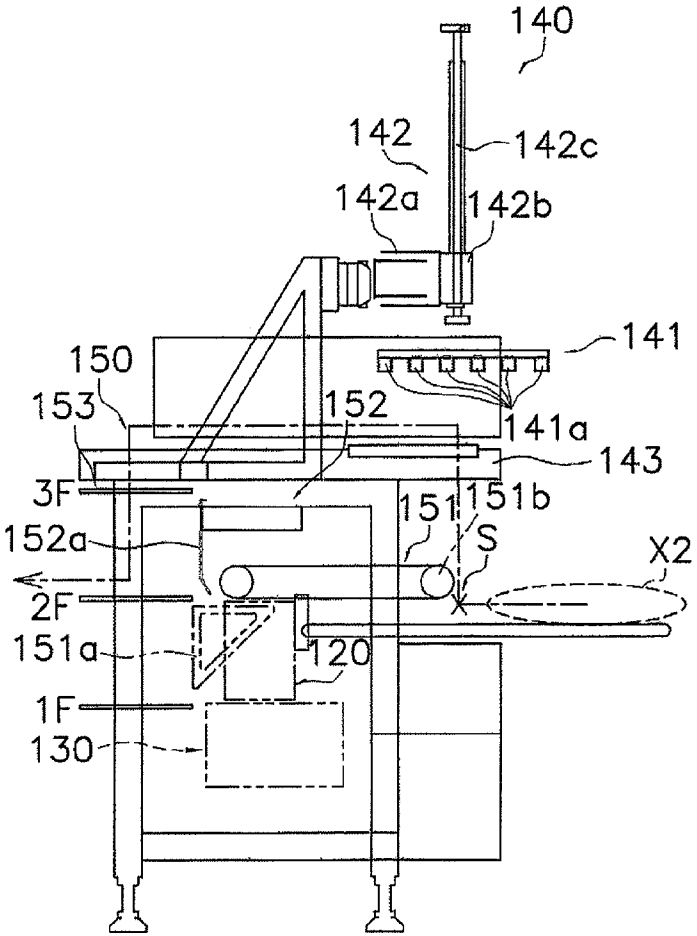
FIG. 6B is a front elevational view of the accumulation device illustrated in FIGS. 3 to 5 showing a second transport path of the products in the transport mechanism when the products are accumulated according to a second accumulation pattern in accordance with the first embodiment of the present invention.
Figure 6A:
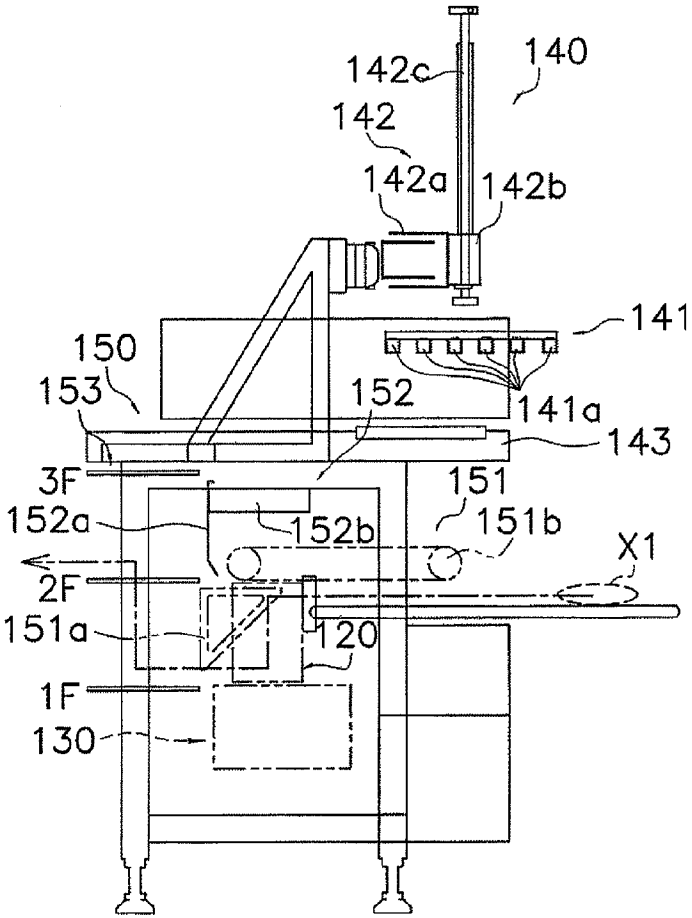
FIG. 6A is a front elevational view of the accumulation device illustrated in FIGS. 3 to 5 showing a first transport path of the products in the accumulation device when the products are accumulated according to a first accumulation pattern in accordance with the first embodiment of the present invention.

In the first embodiment, a state is assumed in the transport mechanism 130 in which a prescribed number of products X1 are accumulated, and the products X1 are transported through a transport path (first transport path) such as the one shown in FIG. 6A to a 2F layer that is a shared discharge position in the discharge device 150.

Figure 9:
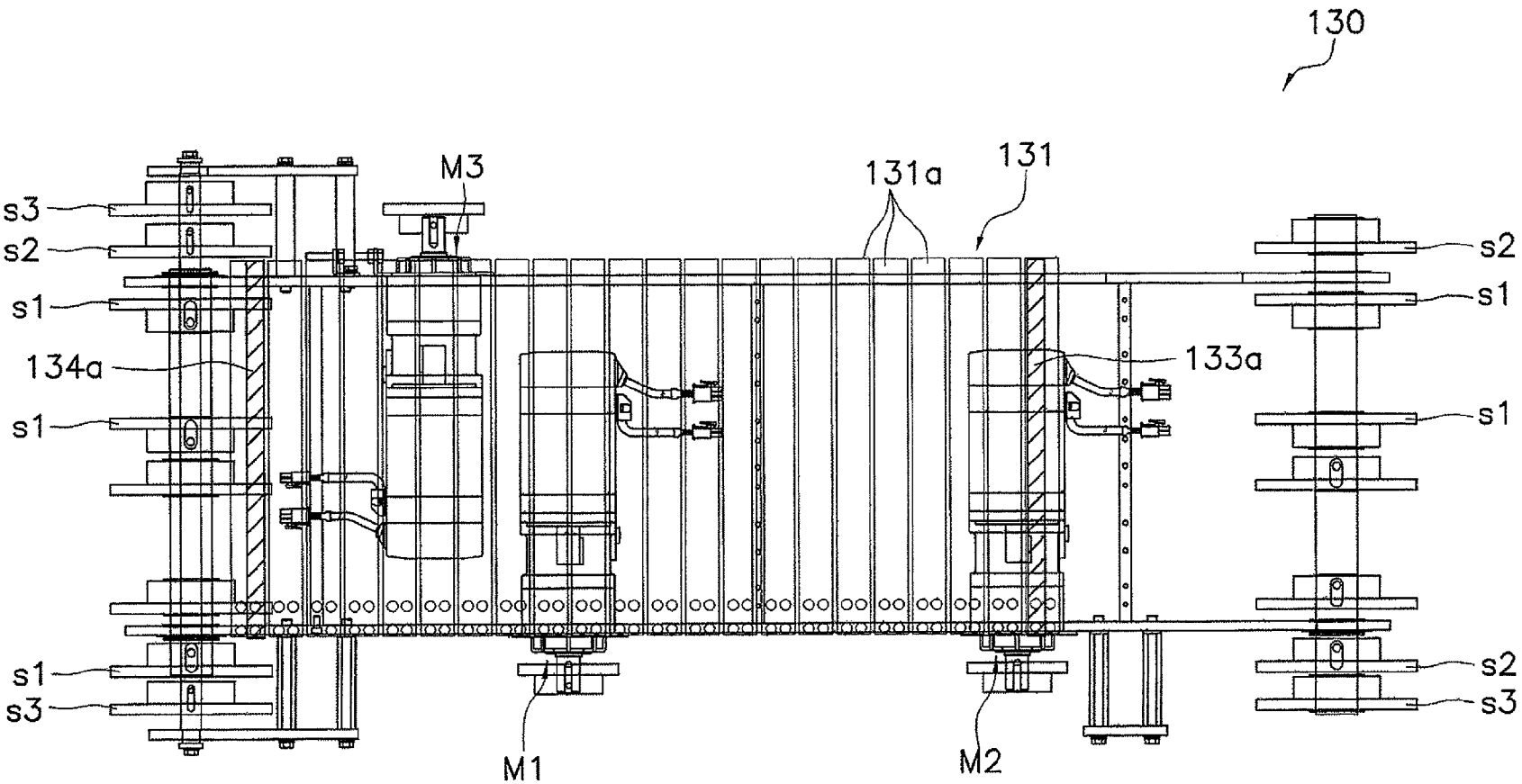
FIG. 9 is a top plan view of the transport mechanism illustrated in FIG. 7 in accordance with the first embodiment of the present invention.
Figure 10:
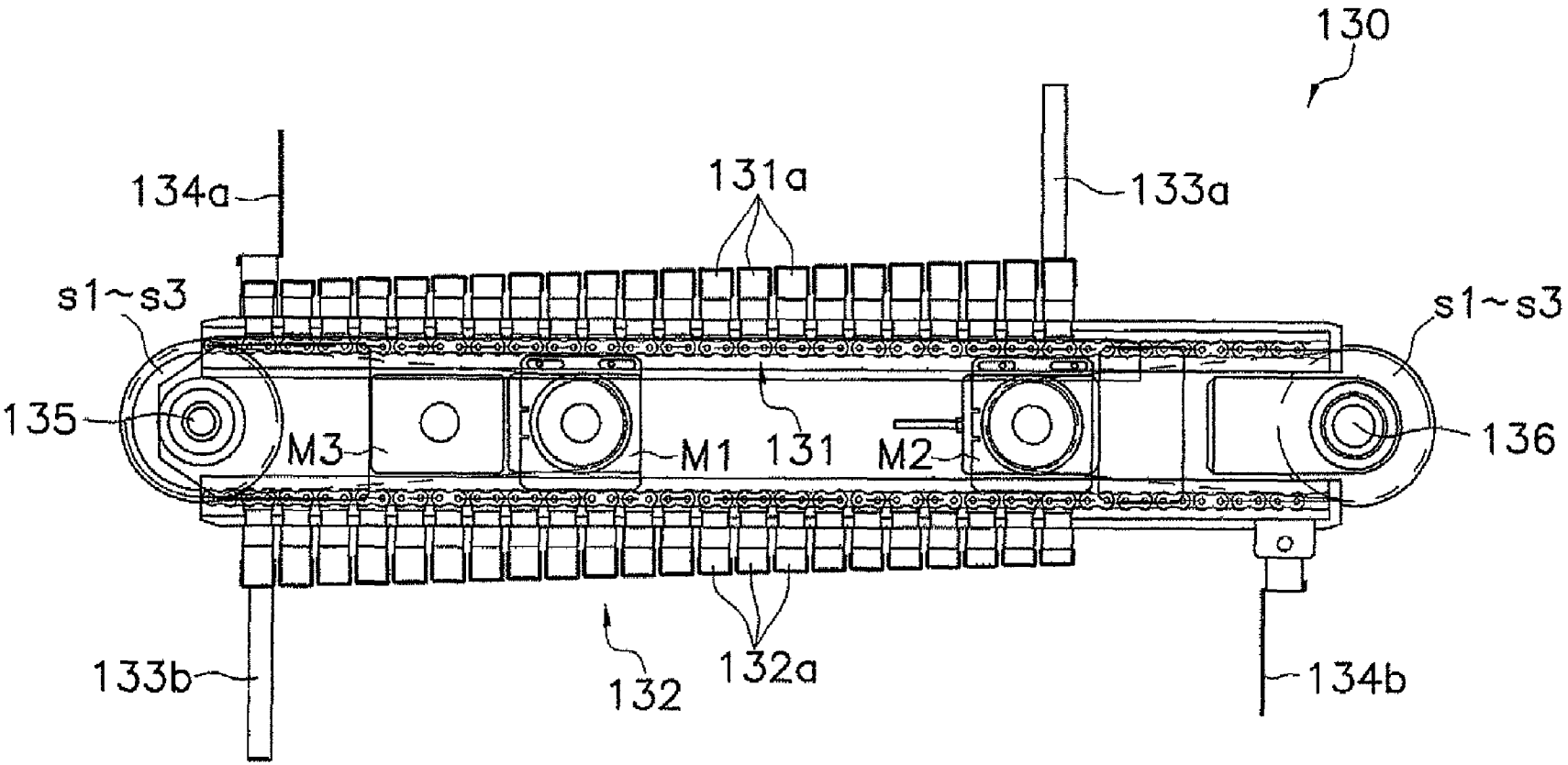
FIG. 10 is an enlarged partial side elevational view of the transport mechanism illustrated in FIGS. 7 and 9 in accordance with the first embodiment of the present invention.

As shown in FIGS. 7, 9 and 10, the transport mechanism 130 is structured so as to include a pair of buckets (transport conveyors) 131, 132, a dividing panel 133*a*, a dividing panel 133*b*, back panels 134*a*, 134*b*, and drive motors M1 through M3. The transport mechanism 130 sequentially receives the products X1 that are received in an upright orientation in the prescribed position Q from the orientation change mechanism 120, and intermittently transports a prescribed number of the products X1 at a time to the downstream discharge position R.

The buckets 131, 132 are provided one at a time on the upstream side and the downstream side, respectively, in the transport mechanism 130. The bucket 131 travels in a loop along a chain that is extended between sprockets s2, s2 that rotate about rotational axis 135. The bucket 132 travels in a loop along a chain that is extended between sprockets s2, s2 that rotate about rotational axes 136. The buckets 131, 132 transport a bundle of a plurality of products X1 that is placed thereon from a prescribed upstream position P to the downstream discharge position R. The buckets 131, 132 are each composed of a combination of a plurality of bottom panels 131*a*, 132*a*.

The dividing panels 133*a*, 133*b* are attached to the bottom panels 131*a*, 132*a*, respectively, that are disposed furthest downstream (towards the leading end) among the plurality of bottom panels 131*a*, 132*a*. The plurality of products X1 that is subsequently transferred can be aligned on the buckets 131, 132 while the product X1 at the leading end of a bundle of a plurality of products X1 that is transferred from the transfer platforms 122 is maintained in the upright orientation by the dividing panels 133*a*, 133*b*. The dividing panels 133*a*, 133*b* are each independently driven via the sprockets s1, s2 by the drive motors M1, M2 described hereinafter. Furthermore, the surfaces of the dividing panels 133*a*, 133*b* that come in contact with the products X1 are comb-shaped, and are formed so as to intersect with the comb-shaped portions of the abovementioned transfer platforms 122 without touching each other.

The back panels 134*a*, 134*b* are members for supporting from below a bundle of the plurality of products X1 that are placed on the buckets 131, 132, and one each of the back panels 134*a*, 134*b* is provided to the dividing panels 133*a*, 133*b*, respectively. The back panels 134*a*, 134*b* are driven by the drive motor M3 that is a shared drive source, and are attached in positions that face each other in the moving loop. The back panels 134*a*, 134*b* are thus driven by a drive source that is separate from that of the dividing panels 133*a*, 133*b*, whereby the bundle of products X1 can be held between the dividing panels 133*a*, 133*b*, and the bundle of products X1 can be stably transported to the discharge position R even when the number of the prescribed number of products X1 to be boxed is changed. The aspect whereby the surfaces of the back panels 134*a*, 134*b* that come in contact with the products X1 are comb-shaped, and are formed so as to intersect with the comb-shaped portions of the abovementioned transfer platforms 122 without touching each other is the same as in the dividing panels 133*a*, 133*b*.

The sprockets s1 through s3 have the same diameter and are disposed at both end portions in the transport mechanism 130. The dividing panel 133*a*, the dividing panel 133*b*, and the back panels 134*a*, 134*b* can thereby be moved at the same speed and at the same rotational speed.

In the first embodiment as described above, a configuration is adopted whereby the dividing panel 133*a*, the dividing panel 133*b*, and the back panels 134*a*, 134*b* are each independently driven; a first loop is formed by the drive motor M1 that drives the dividing panel 133*a*; a second loop is formed by the drive motor M2 that drives the dividing panel 133*b*; and a third loop is formed by the drive motor M3 that drives the back panels 134*a*, 134*b*.

Bundles of a plurality of products X1 are transported so as to be held between the dividing panel 133*a* and the back panels 134*a*, and between the dividing panel 133*b* and the back panel 134*b*, whereby the products can be transported in the transport mechanism 130 with significantly greater stability than in the conventional technique.

The method for transporting a bundle of products X1 using the transport mechanism 130 will be specifically described below using the bucket 131 as an example. Transport in the other bucket 132 is performed in the same manner as described below.

Specifically, the bucket 131, which is standing by in the prescribed position Q to which the products X1 are transferred, receives the product X1 at the leading end while the product X1 is retained in the upright orientation by the dividing panel 133*a* when the products X1 are transported from the upstream transfer platforms 122. The bucket 131 moves downstream a prescribed interval that corresponds to the thickness of the bags of the products X1, whereby the plurality of products X1 are received in an aligned state behind the product X1 that is received at the leading end. At this time, the back panel 134*a* stands by downstream of the prescribed position Q (see FIG. 7) in which the products X1 are received. The dividing panel 133*b* that corresponds to the downstream bucket 132 stands by immediately downstream of the back panel 134*a*. In this arrangement, when a prescribed number of products X1 have been transferred into a bundle, the bundle of the plurality of products X1 held between the dividing panel 133*a* and the back panel 134*a* is transported to the downstream discharge position R (see FIG. 7) in the transport direction "b." At this time, the dividing panel 133*b* that was standing by immediately downstream in the transport direction "b" (see FIG. 5) of the back panel 134*a* rapidly moves downstream of the back panel 134*a* and receives the next batch of products X1 from the transfer platforms 122.

In each of the buckets 131, 132, the plurality of bottom panels 131*a*, 132*a* is disposed in positions that elevate from the upstream side to the downstream side, as shown in FIG. 1. Therefore, the leading bottom panels 132*a* of the bucket 132 can overlap on the downstream bottom panels 131*a* of the bucket 131 in the lowest position, for example. Since the bucket 132 can thereby be caused to stand by in a closer position to the prescribed position Q at which the products X1 are received from the transfer platforms 122, when a prescribed number of products X1 are placed on the bucket 131 and moved downstream, the products X1 can be rapidly moved to the prescribed position Q and received, thereby enabling high-speed operation. The bucket 131 can also overlap the downstream bottom panels 132*a* of the bucket 132 in the same manner.

Structure of Vacuum Transport Mechanism 140

Figure 4:
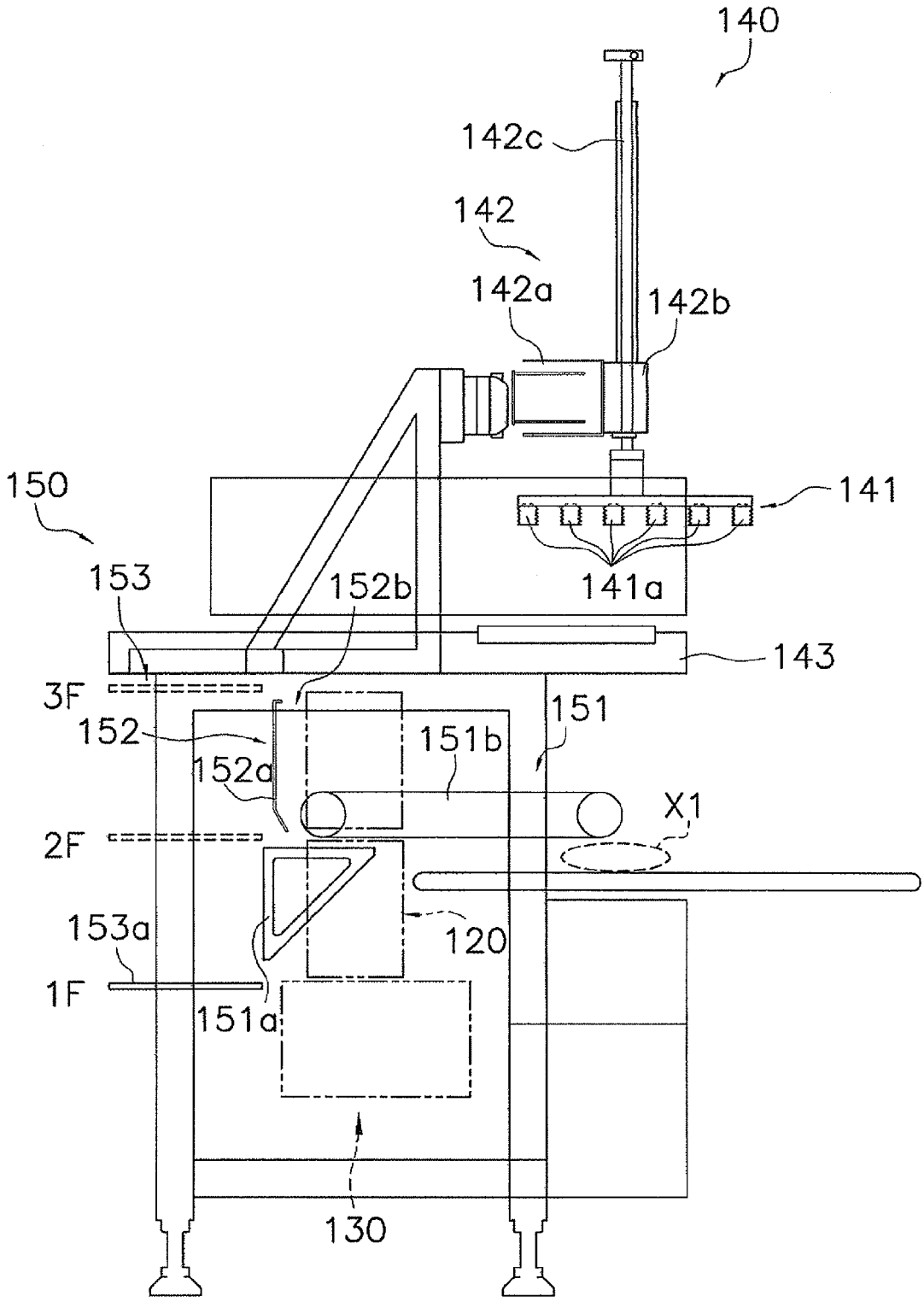
FIG. 4 is a partial front elevational view of the accumulation device illustrated in FIG. 3 in accordance with the first embodiment of the present invention.

The vacuum transport mechanism 140 is a mechanism for processing products X2 that differ in size from the products X1 that are accumulated in the transport mechanism 130 described above, and for processing products X1 that are accumulated according to a different accumulation pattern than the transport mechanism 130. The vacuum transport mechanism 140 is disposed above the transport mechanism 130 in the substantially vertical direction. The vacuum transport mechanism 140 has a vacuum unit 141, a three-dimensional transport unit 142, and a transport platform 143, as shown in FIGS. 3 and 4.

The vacuum unit 141 has vacuum ports 141*a* at the portion that makes contact with the products X2 or the like, and the direction of the products X2 is changed, or the products X2 are transported in a prescribed direction in a state in which the products X2 are retained by a negative pressure generated in the vacuum ports 141*a*.

The three-dimensional transport unit 142 is a transport mechanism that has the same function as a so-called robotic arm that moves the vacuum unit 141 toward a prescribed position. As shown in FIGS. 3 and 4, the three-dimensional transport unit 142 includes a first horizontal transport part 142*a*, a second horizontal transport part 142*b*, and a vertical transport part 142*c*. The first horizontal transport part 142*a* moves the vacuum unit 141 along the direction viewed from the front of the device, i.e., the accumulation direction of the products X1 in the transport mechanism 130. The second horizontal transport part 142*b* moves the vacuum unit 141 along the left-right direction as viewed from the front of the device, i.e., the direction that intersects with the accumulation direction of the products X1 in the transport mechanism 130. The vertical transport part 142*c* moves the vacuum unit 141 in the vertical direction.

The transport platform 143 is on a higher level than the transport surface of the conveying device 110, and is disposed below and diagonal to the standby position of the vacuum unit 141. Products X2 that are lifted from the transport surface of the conveying device 110 by the vacuum unit 141 and the three-dimensional transport unit 142 are accumulated according to a prescribed accumulation pattern. In the first embodiment, an accumulation pattern in which two products X2 are accumulated on the transport platform 143 is adopted for large-sized products X2, as shown in FIG. 3.

Specifically, in the vacuum transport mechanism 140, when products X2 that are larger than the products X1 are transported in the conveying device 110, the vacuum unit 141 is moved by the three-dimensional transport unit 142 from the prescribed standby position to a vacuum position S (see FIG. 6B) at which the products X2 are vacuum retained. The vacuum transport mechanism 140 vacuum-retains the products X2 in the vacuum position S on the transport surface of the conveying device 110, and moves the products X2 from the transport surface of the conveying device 110 to the transport surface of the transport platform 143 that is disposed above.

In the first embodiment, the three-dimensional transport unit 142 moves the vacuum unit 141 to the prescribed position, whereby products X2 that are larger than the products X1 accumulated via the first transport path can be transported to the 2F level in the discharge device 150 as a discharge position that is shared with the products X1, via a separate transport path (second transport path) such as the one shown in FIG. 6B.

Structure of Discharge Device 150

As shown in FIGS. 3 through 5 and other diagrams, the discharge device 150 is disposed directly downstream of the transport mechanism 130 and the vacuum transport mechanism 140 described above, and the bundle of products X1 accumulated in the upright orientation that are transported by the transport mechanism 130 to the discharge position R on the buckets 131, 132, or the products X2 that are accumulated in the vacuum transport mechanism 140 described hereinafter, are pushed horizontally into a cardboard box Y (see FIG. 1). As shown in FIG. 4, the discharge device 150 has a first cross-feed mechanism 151, a second cross-feed mechanism (packing unit) 152, and a lift mechanism 153 as cross-feed mechanisms for cross-feeding in two levels.

First Cross-Feed Mechanism 151

The first cross-feed mechanism 151 cross-feeds the bundle of products X1 that is moved to the discharge position R in the abovementioned transport mechanism 130 and transports the bundle onto the lift mechanism 153. The first cross-feed mechanism 151 has a pusher 151*a* for pushing the bundle of products X1, and a movement mechanism 151*b* for moving the pusher 151*a* back and forth within a prescribed range.

The pusher 151*a* is a panel-shaped member that stands by in the vicinity of the discharge position R in the transport mechanism 130. The pusher 151*a* pushes the bundle of products X1 that is sequentially transported by the buckets 131, 132 towards a transport direction "c" (see FIG. 5) that is substantially orthogonal to the transport direction "b," and moves the bundle of products X1 onto the transport surface 153*a* of the lift mechanism 153 that is standing by in the 1F level portion shown in FIG. 4.

The movement mechanism 151*b* supports the pusher 151*a* from above and drives the pusher 151*a* so that the bundle of products X1 is moved from the transport mechanism 130 onto the transport surface 153*a* of the lift mechanism 153.

Second Cross-Feed Mechanism 152

The second cross-feed mechanism 152 is disposed in an upper level of the first cross-feed mechanism 151, and pushes the bundle of products X1 that is lifted from the 1F level to the 2F level by the lift mechanism 153 described hereinafter, or the products X2 that are lowered by the lift mechanism 153 from the 3F level to the 2F level, into a cardboard box Y from off the transport surface 153*a* of the lift mechanism 153. The second cross-feed mechanism 152 also has a pusher 152*a* and an electric cylinder 152*b*.

After the bundle of products X1 is pushed into the cardboard box Y by the second cross-feed mechanism 152, the abovementioned products X2 are pushed in the same manner by the second cross-feed mechanism 152 into the space between the upper end part of the bundle of products X1 and the inner wall at the top of the cardboard box Y.

As shown in FIG. 4, the pusher 152*a* stands by in the position facing the cardboard box Y so that the lift mechanism 153 is held between the pusher 152*a* and the cardboard box Y in which the products X1, X2 are packed.

The electric cylinder 152*b* is disposed behind (on the opposite side from the surface of contact with the products X1, X2) the pusher 152*a*, and pushes the pusher 152*a*, whereby the bundle of a plurality of products X1 that is moved upward by the lift mechanism 153, or the products X2 that have been moved from the 3F level to the 2F level by the lift mechanism 153, are transported toward a box-packing mechanism 164 and packed into the cardboard box Y.

Lift Mechanism 153

As shown in FIGS. 6A and 6B, the lift mechanism 153 moves the bundle of a plurality of products X1 cross-fed from the transport mechanism 130 by the first cross-feed mechanism 151, or the large-sized products X2 that are accumulated in the vacuum transport mechanism 140, in a substantially vertical direction to a position that is at a height that allows cross-feeding by the second cross-feed mechanism 152. Specifically, the lift mechanism 153 moves through the three levels that include 1F, 2F, and 3F shown in FIG. 4, and moves the bundle of products X1 accumulated in the transport mechanism 130, and the products X2 accumulated in the vacuum transport mechanism 140 from the 1F level and the 3F level to the 2F level portion that is the shared discharge position.

In the box packing system 101 of the first embodiment, products X1 and products X2 that are accumulated in different accumulation patterns can be smoothly transported in the prescribed direction and packed into a cardboard box Y from the orientation change mechanism 120 via the transport mechanism 130 or the vacuum transport mechanism 140 in the manner described above. Therefore, even when accumulation processing is performed according to different accumulation patterns in the box packing system 101, products X1, X2 having different sizes or accumulation patterns can be automatically packed into a box, and the efficiency of the operation from accumulation processing to box packing of the products X1, X2 can be significantly enhanced.

Structure of Flap Opening Device 160

As shown in FIG. 1, the flap opening device 160 is disposed in a position that faces the transport direction "c" (see FIG. 5) in which the discharge device 150 pushes the products X1, X2, and the flap opening device 160 opens a flap for covering the opening of the cardboard box Y in order to pack the cardboard box Y with the products X1, X2 that are transported from the discharge device 150. The flap opening device 160 has a first transport mechanism 161, a second transport mechanism 162, a flap opening part 163, a box packing mechanism 164, and a discharge part 165, as shown in FIG. 1.

The first transport mechanism 161 transports an empty cardboard box Y to a position at which a tab attached to the distal end portion of the flap opening part 163 is inside the opening of the cardboard box.

The second transport mechanism 162 is disposed between the box packing mechanism 164 and the flap opening part 163 in the vertical direction, and transports the cardboard box Y that is opened by the flap opening part 163 to the box packing mechanism 164 disposed below the flap opening part 163.

The flap opening part 163 is disposed adjacent to and downstream of the first transport mechanism 161, and performs preparation prior to packing the products X1, X2 into the cardboard box Y. Specifically, the flap for covering the opening of the cardboard box Y is opened by inserting the tab attached to the distal end portion into the closed cardboard box Y to hold the cardboard box Y open.

The box packing mechanism 164 is disposed adjacent to and downstream of the second transport mechanism 162 and the discharge device 150, and the products X1, X2 that are discharged by the discharge device 150 are pushed into and stored in the cardboard box Y that is transported by the second transport mechanism 162 in a state in which the flap is opened.

The discharge part 165 is disposed adjacent to and downstream of the box packing mechanism 164, and the cardboard box Y for storing the products X1, X2 that is rotated so that the opening faces upward is discharged to the outside of the device.

Characteristics of Box Packing System 101

(1) In the box packing system 101 of the first embodiment, the products X1 (a first group of the products) and the products X2 (a second group of the products) transported from the conveying device 110 are accumulated according to a first accumulation pattern in a first accumulation processing unit (the orientation change mechanism 120 and the transport mechanism 130) and according to a second accumulation pattern in a second accumulation processing unit (the vacuum transport mechanism 140) that are disposed parallel to each other, as shown in FIGS. 6A and 6B. The products X1, X2 accumulated in the transport mechanism 130 and the vacuum transport mechanism 140, respectively, are discharged towards the flap opening device 160 that is disposed downstream from the 2F level portion of the discharge device 150, which is a shared discharge position.

According to this configuration, even when products X1, X2 of different sizes are accumulated according to different accumulation patterns, for example, the products can be efficiently processed in a single device by accumulating the products X1, X2 in the transport mechanism 130 and the vacuum transport mechanism 140, respectively, as two accumulation processing units that are disposed parallel to each other. As a result, even when products X1, X2 of different sizes are packed into the same cardboard box Y, for example, there is no need for manual box packing, the process from accumulation to box packing can be automated, and increased efficiency can be anticipated. Furthermore, since there is no need to provide an accumulation device for each accumulation pattern, reduced cost and reduced space requirements for the production line can be anticipated.

(2) In the box packing system 101 of the first embodiment, the transport mechanism 130 and the vacuum transport mechanism 140 as two accumulation processing units disposed parallel to each other are disposed in a vertical alignment as shown in FIGS. 3 and 4, and other diagrams.

According to this configuration, even when a plurality of accumulation processing units is mounted, the device can be prevented from increasing in size, and reduced space requirements can be anticipated by performing accumulation processing according to different accumulation patterns in a plurality of accumulation processing units (transport mechanism 130 and vacuum transport mechanism 140) that is disposed so as to align vertically.

(3) In the box packing system 101 of the first embodiment, the orientation change mechanism 120 for transferring the products X1 onto the buckets 131, 132 of the transport mechanism 130 so as to be in a prescribed accumulation pattern, and the transport mechanism 130 for accumulating the products X1 in an aligned state that are received from the orientation change mechanism 120 are used as one of the two accumulation processing units that are disposed parallel to each other, as shown in FIG. 7.

According to this configuration, accumulation processing can be performed in a plurality of accumulation patterns such as an upright orientation, a "sashimi" format, a lay-flat format, or other accumulation pattern by controlling the timing and other characteristics of the products X1 transferred onto the buckets 131, 132 of the transport mechanism 130 from the orientation change mechanism 120. As a result, a box packing system 101 can be obtained that is capable of adapting to accumulation according to various accumulation patterns in addition to the accumulation pattern created in the other accumulation processing unit (vacuum transport mechanism 140).

(4) In the box packing system 101 of the first embodiment, the vacuum transport mechanism 140 is used as the other accumulation processing unit of the two accumulation processing units that are disposed parallel to each other, as shown in FIG. 4 and other diagrams.

According to this configuration, by vacuum-transporting products X2 that are larger than the plurality of regularly accumulated and packed products X1, and that cannot be accumulated in the transport mechanism 130, the products can be transported to the 2F level of the discharge device 150 as the shared discharge position after the orientation is changed, and accumulation processing is performed via a separate transport path. As a result, a box packing system 101 can be obtained that is adaptable to an even greater variety of accumulation patterns.

(5) In the box packing system 101 of the first embodiment, accumulation processing according to different accumulation patterns is performed in parallel fashion in the two accumulation processing units that include the transport mechanism 130 and the vacuum transport mechanism 140, as shown in FIGS. 6A and 6B.

According to this configuration, even when products having different sizes such as the products X1, X2, for example, are accumulated according to different accumulation patterns, a plurality of accumulations can be efficiently performed through parallel processing.

(6) As shown in FIG. 4, the box packing system 101 of the first embodiment is provided with the lift mechanism 153 for transporting the products X1, X2 that are accumulated in the two accumulation processing units that include the transport mechanism 130 and the vacuum transport mechanism 140 from the 1F and 3F levels to the 2F level as the shared discharge position.

According to this configuration, the products X1, X2 received from the conveying device 110 as a shared receiving unit can be smoothly transported to the 2F level as the shared discharge position after accumulation processing is performed according to different accumulation patterns via different transport channels for each product. As a result, a box packing system 101 can be obtained that is capable of efficient accumulation processing according to a plurality of accumulation patterns without increasing the size of the device.

(7) As shown in FIG. 3 and other diagrams, in the box packing system 101 of the first embodiment, flexible packaging products X1, X2 in which confections or the like are placed are used as the products that are accumulated in the plurality of accumulation processing units that includes the transport mechanism 130 and the vacuum transport mechanism 140.

According to this configuration, even when the products are flexible packaging whose orientation is difficult to control during transport and other processes in relation to a box-shaped product or the like, for example, various accumulation patterns can be adapted to in the transport mechanism 130 and the vacuum transport mechanism 140, and the prescribed accumulation processing can easily be performed for the flexible packaging products X1, X2.

(8) In the box packing system 101 of the first embodiment, the products X1, X2 that are accumulated according to different accumulation patterns in the two accumulation processing units (transport mechanism 130 and vacuum transport mechanism 140) described above are packed into a cardboard box Y by the second cross-feed mechanism 152, as shown in FIGS. 1, 4, and other diagrams.

According to this configuration, even when accumulation processing is performed according to different accumulation patterns, the different accumulations can be efficiently performed by performing the accumulation processing in the respective transport mechanism 130 and vacuum transport mechanism 140 as the two accumulation processing units that are disposed parallel to each other. As a result, a box packing system 101 can be obtained whereby the process from accumulation to box packing can be automated, and increased efficiency can be anticipated, reduced cost and reduced space requirements for the production line can also be anticipated.

Accordingly, with the accumulation device of the first embodiment of the present invention, a plurality of products can be accumulated according to a plurality of accumulation patterns in a single accumulation device without reducing the processing efficiency.

Modified Examples of First Embodiment

Although the first embodiment of the present invention was described above, the present invention is not limited by the embodiment described above, and various modifications may be made within the intended scope of the invention.

(A) In the first embodiment described above, an example was described in which the orientation change mechanism 120 and the transport mechanism 130 for accumulating the products X1 in an upright state on the buckets 131, 132 as received from the orientation change mechanism 120, and the vacuum transport mechanism 140 that has the vacuum ports 141*a* at the distal end and accumulates the products X2 that are larger than the products X1 were used as the first accumulation processing unit and the second accumulation processing unit for performing accumulation processing according to different accumulation patterns, as shown in FIG. 3. However, the present invention is not limited by this configuration.

For example, the combination of the first accumulation processing unit and the second accumulation processing unit as described above is not limiting, and a configuration may be adopted that includes a plurality of only the orientation change mechanism 120 and the transport mechanism 130 disposed parallel to each other as the first accumulation processing unit described in the abovementioned embodiment, or a configuration that includes a plurality of only the vacuum transport mechanism 140 as the second accumulation processing unit disposed parallel to each other.

Even in this case, by performing accumulation processing according to different accumulation patterns in each of a plurality of accumulation processing units disposed parallel to each other, the same effects as those described above can be obtained, whereby accumulation processing according to a plurality of accumulation patterns can be efficiently performed in a single device.

(B) An example was described in the first embodiment in which the orientation change mechanism 120 and transport mechanism 130 as the first accumulation processing unit, and the vacuum transport mechanism 140 as the second accumulation processing unit were disposed vertically, as shown in FIG. 3. However, the present invention is not limited by this configuration.

For example, the configuration whereby the first accumulation processing unit and the second accumulation processing unit are disposed in the vertical direction is not limiting, and an arrangement thereof in the left-right direction is also possible.

However, the configuration in which a plurality of accumulation processing units is disposed in a vertical arrangement as described in the first embodiment is preferred in terms of preventing the space requirements of the device from increasing, and for enabling a plurality of accumulations.

(C) An example was described in the first embodiment in which the plurality of products X1 was accumulated in an upright state on the buckets 131, 132 in the transport mechanism 130 that corresponds to the first accumulation processing unit, as shown in FIG. 7. However, the present invention is not limited by this configuration.

For example, a configuration may be adopted in which the products X1 are accumulated in a so-called "sashimi-style" accumulation pattern (diagonal stacking) in which the plurality of products X1 is accumulated at an angle on the buckets so that portions of the products X1 overlap, or a so-called lay-flat-style accumulation pattern in which the products X1 are laid flat in a non-overlapping state.

(D) In the first embodiment described above, an example was described in which products X2 that are larger than the products X1 accumulated in the orientation change mechanism 120 and transport mechanism 130 as the first accumulation processing unit were accumulated in the vacuum transport mechanism 140 as the second accumulation processing unit, as shown in FIG. 3. However, the present invention is not limited by this configuration.

For example, the products accumulated in the first accumulation processing unit and the second accumulation processing unit may have the same size. Even in this case, accumulation processing according to different accumulation patterns can be performed in parallel in a single device by varying the accumulation pattern in the processing of products that are the same size.

Figure 11:
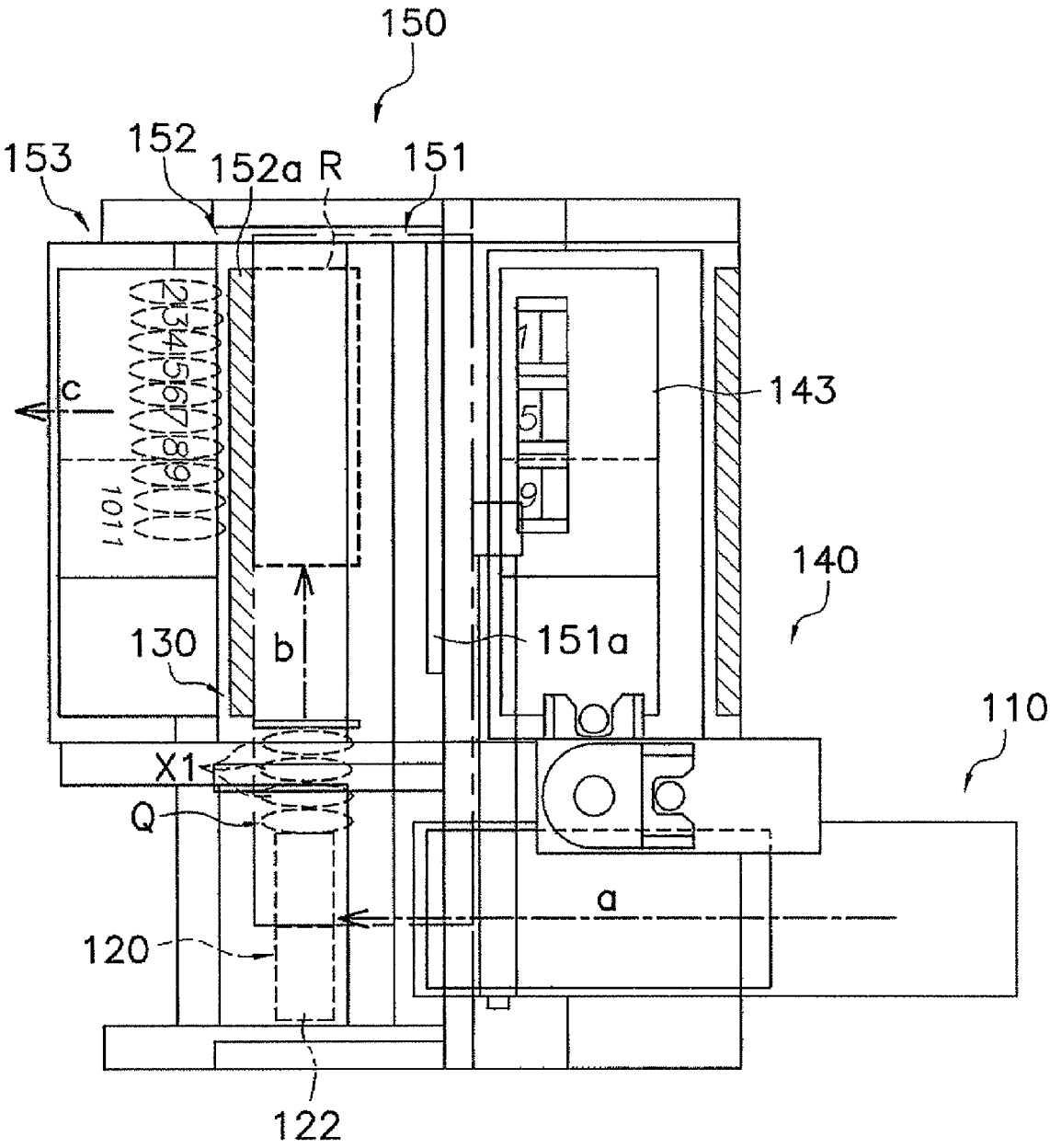
FIG. 11 is an enlarged top plan view of the box packing system illustrated in FIG. 1 when a processing for box packing is performed according to a modified arrangement in accordance with the first embodiment of the present invention.
Figure 12A:
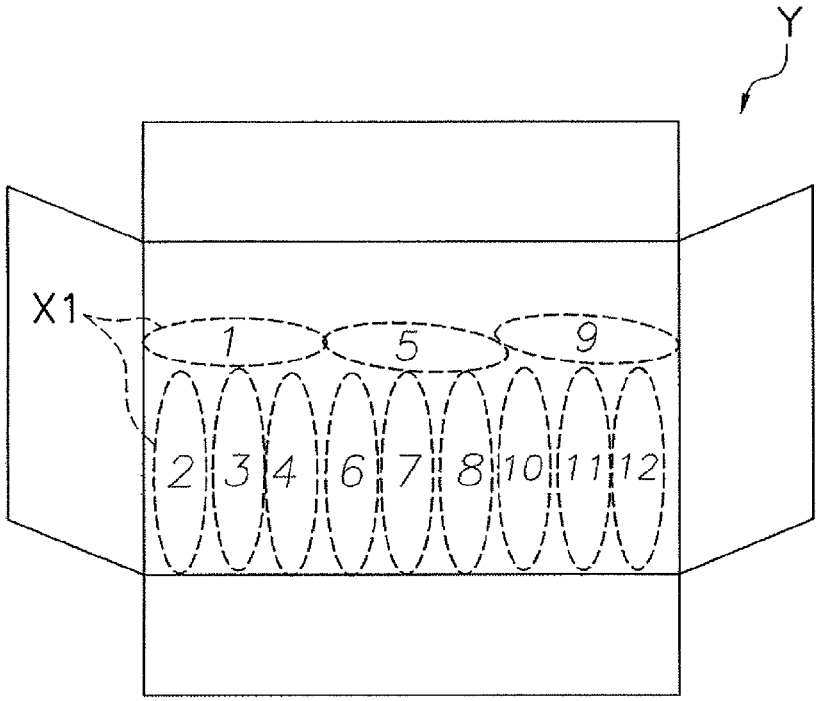
FIG. 12A is a schematic diagram showing a first example of various box packing patterns that can be created by the box packing system illustrated in FIG. 1 in accordance with the first embodiment of the present invention.

Specifically, bags 2, 3, 4, . . . are accumulated in the orientation change mechanism (first accumulation processing unit) 120, and bags 1, 5, 9, . . . are accumulated in the vacuum transport mechanism (second accumulation processing unit) 140, as shown in FIG. 11. Specifically, a large number of bags are accumulated at high speed by the orientation change mechanism 120 while bags are accumulated at a slower speed by the vacuum transport mechanism 140, whereby box packing can be performed in a box packing pattern such as the one shown in FIG. 12A.

Figure 12B:
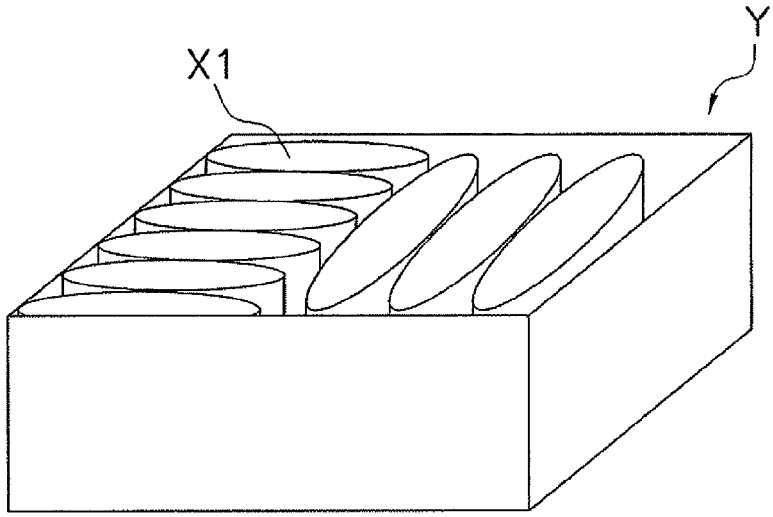
FIG. 12B is a schematic diagram showing a second example of various box packing patterns that can be created by the box packing system illustrated in FIG. 1 in accordance with the first embodiment of the present invention.

Furthermore, box packing can also be performed in a large variety of other box packing patterns, such as the ones shown in FIG. 12B and other diagrams.

(E) In the first embodiment, an example was described in which two products X2 having a larger size than the products X1 accumulated in the orientation change mechanism 120 and transport mechanism 130 as the first accumulation processing unit were accumulated and box-packed in the vacuum transport mechanism 140 as the second accumulation processing unit, as shown in FIG. 3. However, the present invention is not limited by this configuration.

For example, a configuration may be adopted in which only a single large-sized product X2 is transported to the prescribed position and packed in the vacuum transport mechanism 140 as the second accumulation processing unit.

Even in this case, box-packing processing in which a plurality of accumulation patterns is combined may be performed in a single device by packing the product together with a bundle of a plurality of products that is accumulated according to a prescribed accumulation pattern in the first accumulation processing unit.

(F) In the first embodiment, an example was described in which products X1, X2 that were bags formed by flexible packaging, such as packaged confections or the like, were used as the products accumulated according to a prescribed accumulation pattern, as shown in FIG. 3 and other diagrams. However, the present invention is not limited by this configuration.

For example, products placed in a paper box or the like, or other products may be used instead of products that are packed in flexible packaging.

(G) In the first embodiment, an example was described in which the box packing system 101 was the accumulation device of the present invention, as shown in FIG. 1 and other diagrams. However, the present invention is not limited by this configuration.

For example, the accumulation device of the present invention may be mounted in another industrial machine.

The same effects as those of the box packing system 101 according to the first embodiment can be obtained in this case as well.

Second Embodiment

Referring now to FIGS. 13 to 25C, a box packing system having an accumulation device in accordance with a second embodiment will now be explained. In view of the similarity between the first and second embodiments, the descriptions of the parts of the second embodiment that are identical to the parts of the first embodiment may be omitted for the sake of brevity.

Figure 14:
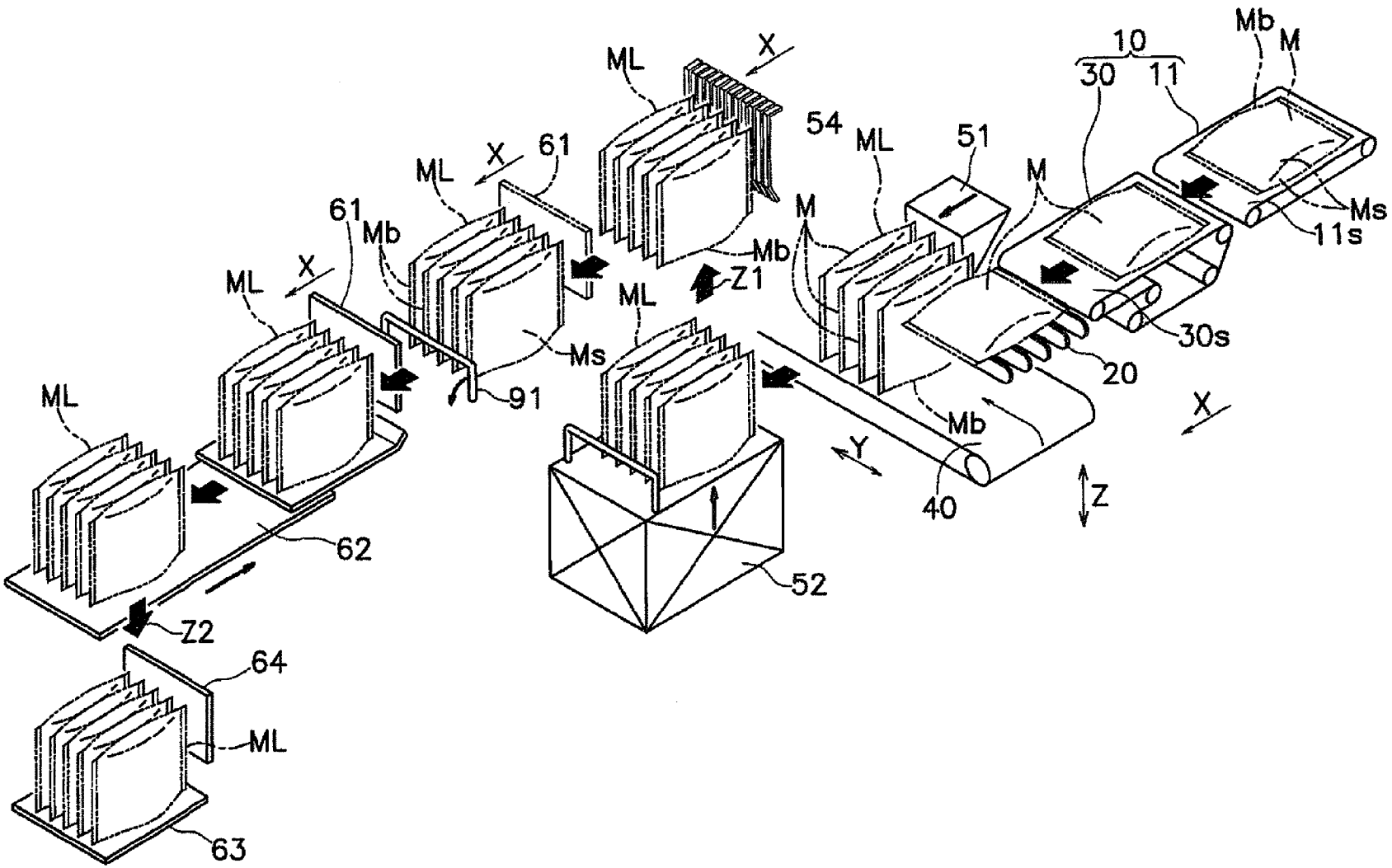
FIG. 14 is a schematic process diagram illustrating the processes of product accumulation and box packing executed in the box packing system in accordance with the second embodiment of the present invention.

Similarly to the first embodiment, packaged potato chips, snacks or the like, for example, are used as the product that is accumulated by the accumulation device. In FIG. 14, the product is indicated by chain double-dashed lines and labeled with the reference symbol M.

Specifically, the products M are bags that accommodate contents, wherein the bags are provided with a pair of main surfaces Ms and a bottom surface Mb that is continuous with the pair of main surfaces Ms. The products M are transported in a state (hereinafter referred to as the "upright orientation") in which the bottom surface Mb is facing downward in contact with the transport surface.

Structure of Box Packing System

Figure 13:
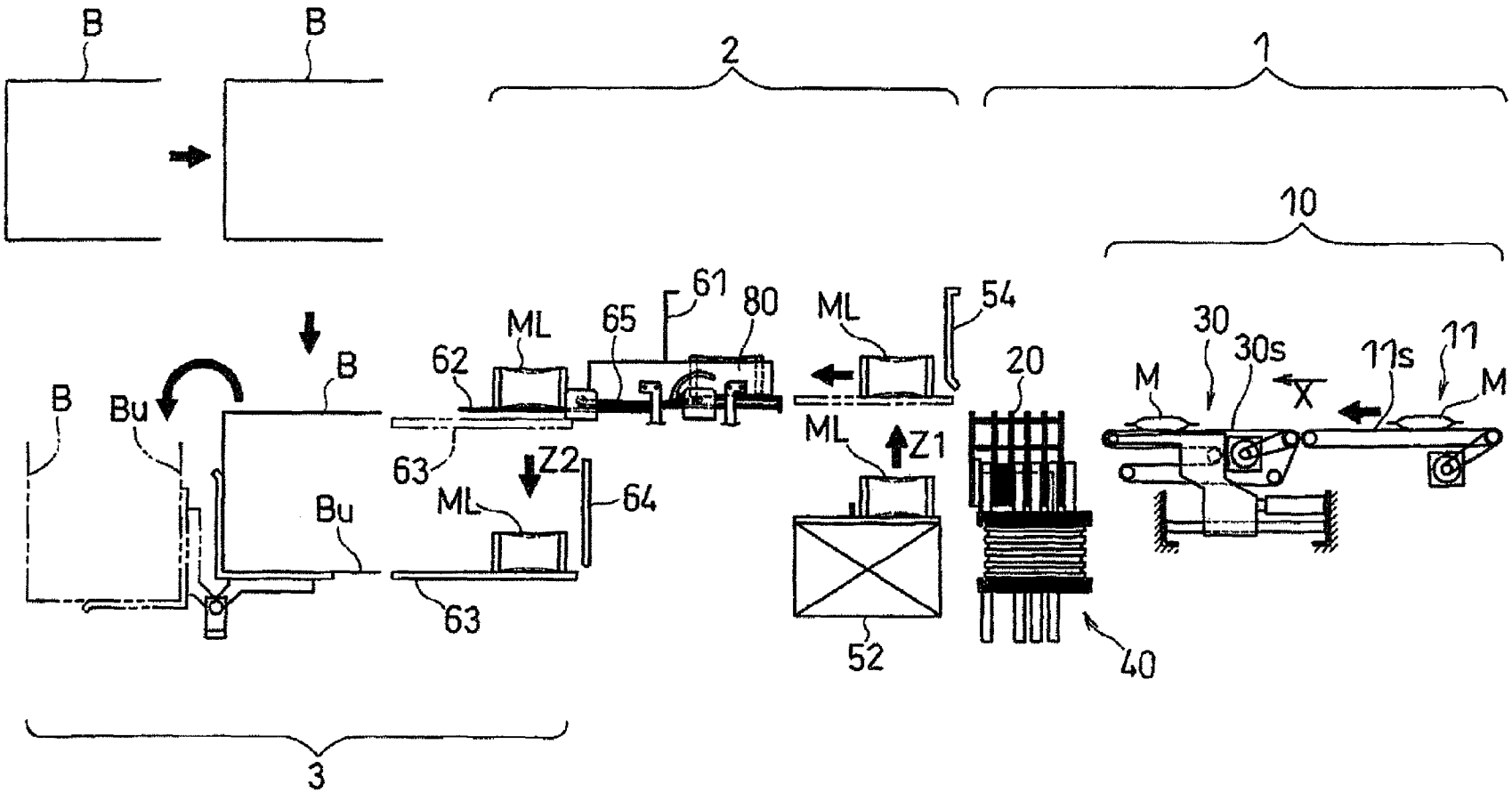
FIG. 13 is a schematic diagram illustrating an operation of a box packing system in accordance with a second embodiment of the present invention.

A box packing system that uses the accumulation device according to the second embodiment will first be described using FIGS. 13 and 14. The box packing system is provided with the accumulation device 1, a product row transporting device 2, and a box packing apparatus 3. The accumulation device 1 is provided with the conveying device 10 (an example of the conveying unit), an orientation change mechanism 20 (example of the orientation changing unit), a telescopic conveyor 30, and a transport mechanism 40 (example of the aligning unit). Moreover, the conveying device 10, the orientation change mechanism 20 and the transport mechanism 40 preferably constitute the accumulation device in accordance with the second embodiment.

As shown in FIG. 14, the conveying device 10 transports the products M in a state (hereinafter referred to as the "horizontal orientation") in which the main surfaces Ms are in contact with the transport surface. The orientation change mechanism 20 changes the orientation of the products M transported by the conveying device 10 from the horizontal orientation to the upright orientation. The transport mechanism 40 aligns the products M with the main surfaces Ms being in contact with each other, and forms a product row ML.

The product row transporting device 2 then pushes the product row ML created by the transport mechanism 40 in the vertical upward direction Z1. The product row transporting device 2 then transports the product row ML to a shutter 62 in a first direction X as shown in FIG. 13.

The box packing apparatus 3 packs the product row ML transported by the product row transporting device 2 into a box. Specifically, the shutter 62 opens, whereby the product row ML that has been transported to the shutter 62 is placed on a raised lifting platform 63 (FIG. 13). The product row ML is then stacked in levels. The lifting platform 63 lowers in the vertical downward direction Z2 in conjunction with the level stacking of the product rows ML. When the lifting platform 63 is in the lowered state, the product row ML stacked on the lifting platform 63 is packed in a box B by a box-packing pusher 64. A cardboard box or the like, for example, is used as the box B.

The structure and operation of each component provided to the box packing system will next be described in detail.

Structure and Operation of Conveying Device 10

FIGS. 15 and 16 are diagrams showing the conveying device 10. The conveying device 10 is provided with an induction conveyor 11 and a telescopic conveyor 30. The products M transported downstream to the induction conveyor 11 are transported onto the telescopic conveyor 30 from the induction conveyor 11.

Specifically, the products M are transported in the first direction X in the horizontal orientation (FIG. 14). At this time, the main surfaces Ms on one side of the products M are supported from below by the transport surfaces 11*s*, 30*s* of the induction conveyor 11 and the telescopic conveyor 30, respectively.

Structure of Induction Conveyor 11

Figure 15A:
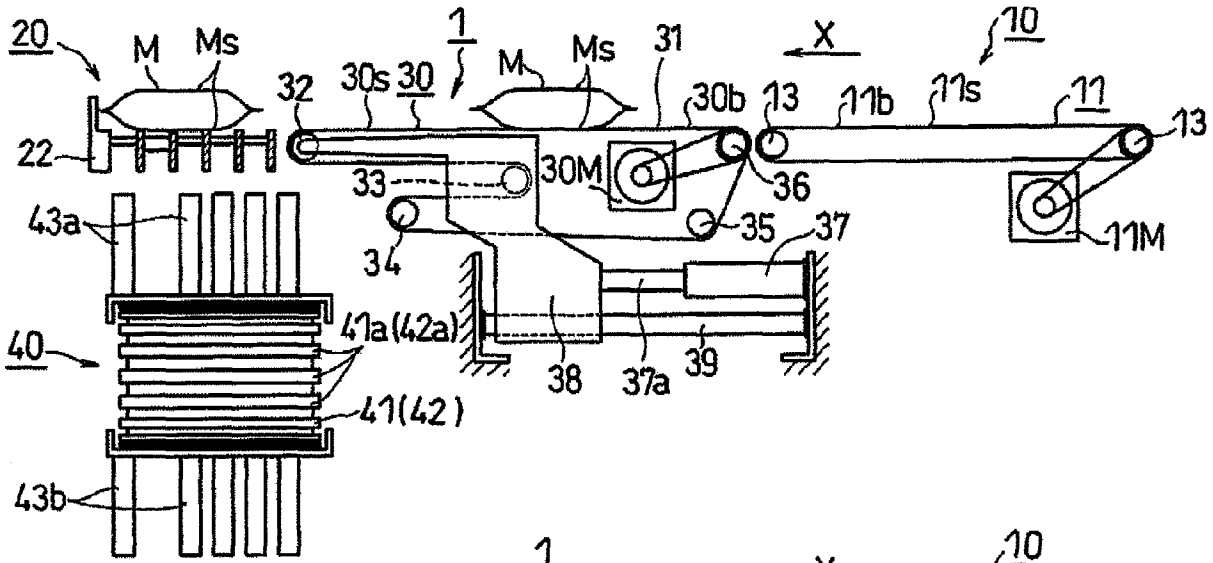
FIG. 15A is a schematic partial side elevational view of an accumulation device of the box packing system illustrating a case in which a conveying device is extended when a transported product is relatively short-size in accordance with the second embodiment of the present invention.
Figure 15B:
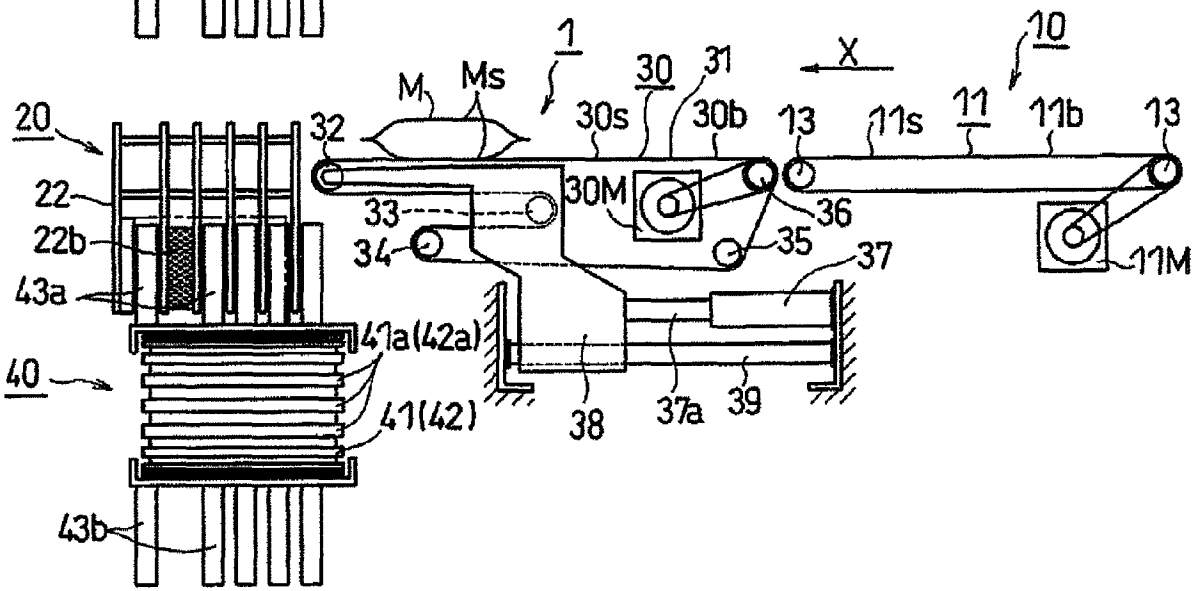
FIG. 15B is a schematic partial side elevational view of the accumulation device of the box packing system illustrating the case in which the conveying device is extended when the transported product is relatively short-size in accordance with the second embodiment of the present invention.

As shown in FIGS. 15A and 15B, the induction conveyor 11 is provided with a pair of pulleys 13, 13 and a conveyor belt 11*b*. The pair of pulleys 13, 13 is disposed so that one pulley is upstream and the other is downstream. The conveyor belt 11*b* is endless, and extends between the pair of pulleys 13, 13.

The upstream pulley 13 can be rotated by the driving of a drive motor 11M. The conveyor belt 11*b* is rotated by the rotation of the upstream pulley 13. The induction conveyor 11 thereby transports the products M on the transport surface 11S toward the telescopic conveyor 30.

Structure of Telescopic Conveyor 30

As shown in FIGS. 15A and 15B, the telescopic conveyor 30 is provided with a first moving roller 32, a first fixed roller 34, a second moving roller 33, a pair of second fixed rollers 35, 36, and a conveyor belt 31. The conveyor belt 31 is endless (annular), and extends along the rollers 32 through 36.

The first moving roller 32 contacts the internal peripheral surface of the conveyor belt 31, and is disposed at the downstream end in the first direction X. The first fixed roller 34 contacts the internal peripheral surface of the conveyor belt 31, and is disposed at the downstream end in the first direction X.

The second moving roller 33 contacts the external peripheral surface of the conveyor belt 31, and is disposed between the first moving roller 32 and the first fixed roller 34. The second fixed rollers 35, 36 contact the internal peripheral surface of the conveyor belt 31, and are disposed at the upstream end in the first direction X.

The conveyor belt 31 is composed of a transport surface 30*s* for transporting the products M between the second fixed roller 36 and the first moving roller 32.

The second fixed roller 36 can be rotated by the driving of a second conveyor motor 30M. The conveyor belt 31 is also rotated by the rotation of the second fixed roller 36. The telescopic conveyor 30 thereby transports the products M on the transport surface 30*s* that have been transported from the induction conveyor 11 to the transfer platforms 22 of the orientation change mechanism 20.

The first moving roller 32 and the second moving roller 33 are both capable of moving, and the telescopic conveyor 30 can extend and retract. This operation will be described in detail hereinafter.

Telescoping Mechanism of Telescopic Conveyor 30

Figure 16A:
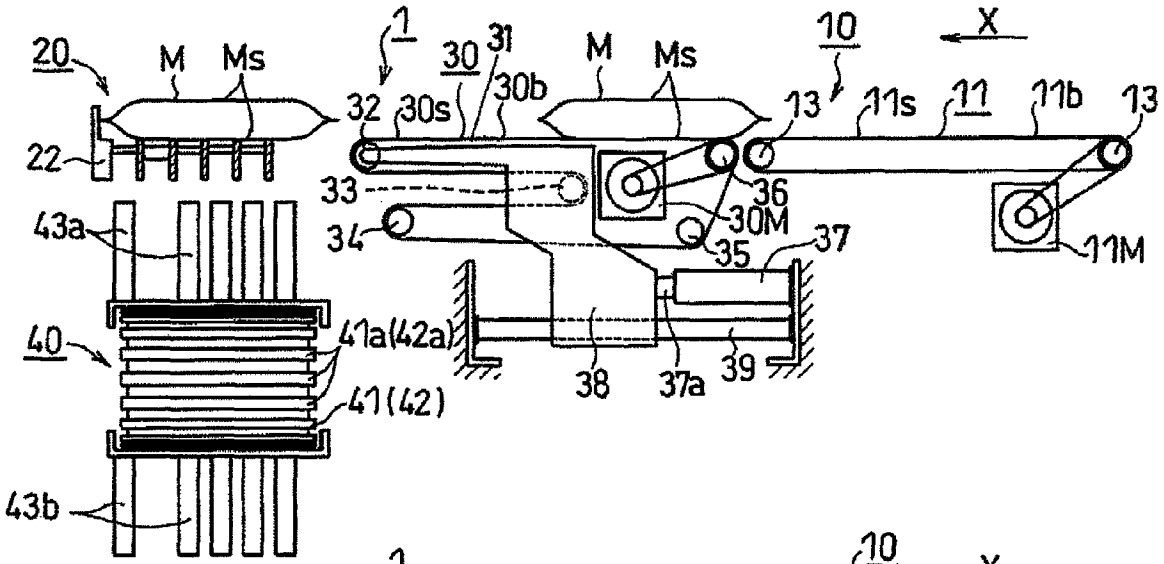
FIG. 16A is a schematic partial side elevational view of the accumulation device of the box packing system illustrating a case in which a conveying device is retracted when a transported product is relatively long-size in accordance with the second embodiment of the present invention.
Figure 16B:
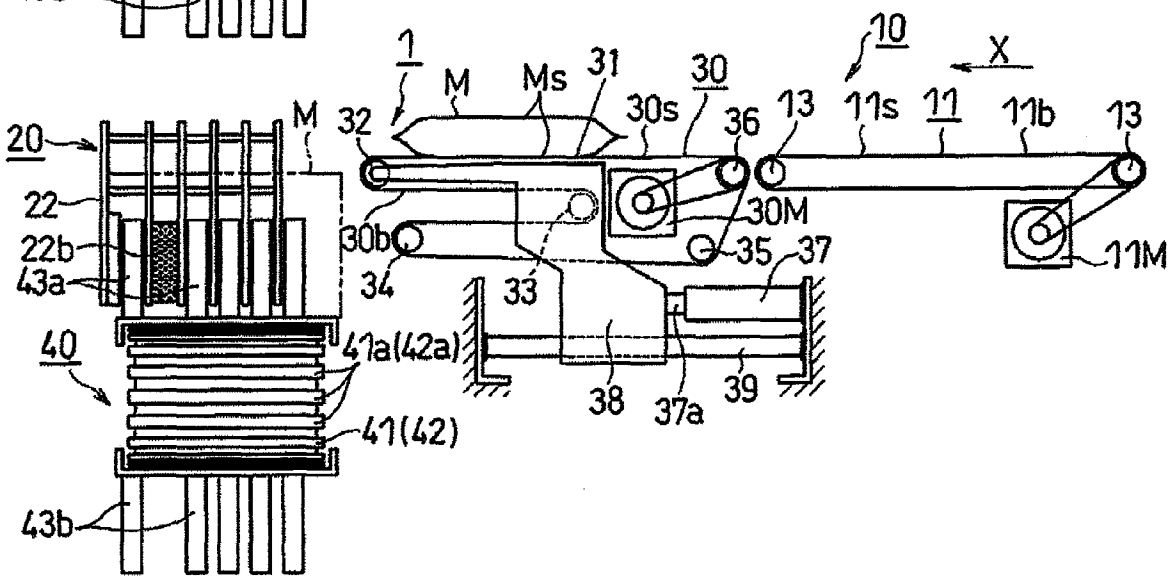
FIG. 16B is a schematic partial side elevational view of the accumulation device of the box packing system illustrating the case in which the conveying device is retracted when the transported product is relatively long-size in accordance with the second embodiment of the present invention.

FIGS. 16A and 16B are diagrams showing the telescopic conveyor 30 in the retracted state. FIGS. 15A and 15B described above show the telescopic conveyor 30 in the extended state.

The first moving roller 32 and the second moving roller 33 are both attached to a slider 38 so as to be able to rotate. The slider 38 is capable of moving in the first direction X along a guide rod 39, and is able to slide with respect to the guide rod 39. The guide rod 39 is provided substantially parallel to the first direction X.

A cylinder rod 37*a* of an air cylinder 37 is fixed to the slider 38. The slider 38 can be moved along the first direction X by the driving of the air cylinder 37.

As shown in FIGS. 15A and 15B, when the slider 38 moves towards the orientation change mechanism 20, the first moving roller 32 and the second moving roller 33 also move towards the orientation change mechanism 20. The distance between the first moving roller 32 and the second fixed roller 36 thereby increases, and the telescopic conveyor 30 extends.

As shown in FIGS. 16A and 16B, when the slider 38 moves away from the orientation change mechanism 20, the first moving roller 32 and the second moving roller 33 also move away from the orientation change mechanism 20. The distance between the first moving roller 32 and the second fixed roller 36 thereby decreases, and the telescopic conveyor 30 retracts.

The distance between the telescopic conveyor 30 and the transfer platforms 22 of the orientation change mechanism 20 can be adjusted by the extension and retraction of the telescopic conveyor 30.

As described hereinafter, the transfer platforms 22 move downward with the products M placed thereon. When the products M are large in size, the telescopic conveyor 30 is retracted to increase the distance to the transfer platforms 22, thereby enabling the transfer platforms 22 to move downward. If the telescopic conveyor 30 were extended at this time so as to reduce the distance to the transfer platforms 22, the products M would be caught on the telescopic conveyor 30 when the transfer platforms 22 moved downward.

When the products M are small in size, the telescopic conveyor 30 is extended to shorten the distance to the transfer platforms 22, thereby enabling the products M to move from the telescopic conveyor 30 to the transfer platforms 22. If the telescopic conveyor 30 were retracted at this time so as to increase the distance to the transfer platforms 22, the products M would fall between the telescopic conveyor 30 and the transfer platforms 22.

The products M are transported at high speed on the transport surface 30*s*, whereby the products M are thrown towards the transfer platforms 22 from the telescopic conveyor 30 and transferred to the transfer platforms 22. The products M can therefore be transported onto the transfer platforms 22 even when the telescopic conveyor 30 and the transfer platforms 22 are apart from each other.

The length of the telescopic conveyor 30 is thus varied according to the size of the products M, thereby enabling the orientation of the products M to be stabilized during transport without regard to the size of the products M. The products M can thus be transferred to the orientation change mechanism 20 in a stable orientation. The products M can also be transferred to the orientation change mechanism 20 in the prescribed cycle time without damage to the contents of the products M.

Extension and retraction of the telescopic conveyor 30 may be automatically performed when the type of the products M changes, on the basis of size information of the products M or bags that is set in a controller provided upstream. More specifically, the accumulation device can be controlled to selectively extend or retract the telescopic conveyor 30 by, for example, receiving a size signal from an upstream packaging device or a main control device (e.g., implemented by a microprocessor, CPU, etc.) even when the length of the products M itself is not detected.

A case was described in which the telescopic conveyor 30 was extended and retracted for two size levels (FIGS. 15A through 16B) for the products M, but a stopper or the like, for example, may also be provided, and extension and retraction for three or more levels may be performed. This configuration makes it possible to adapt to products M having multiple sizes.

Furthermore, extension and retraction of the telescopic conveyor 30 may be controlled so as to occur for each transfer of a product M. Specifically, the telescopic conveyor 30 extends when products M are transferred to the transfer platforms 22 of the orientation change mechanism 20, and retracts during orientation changing of the products M by the transfer platforms 22.

Structure and Operation of Orientation Change Mechanism 20

Figure 17:
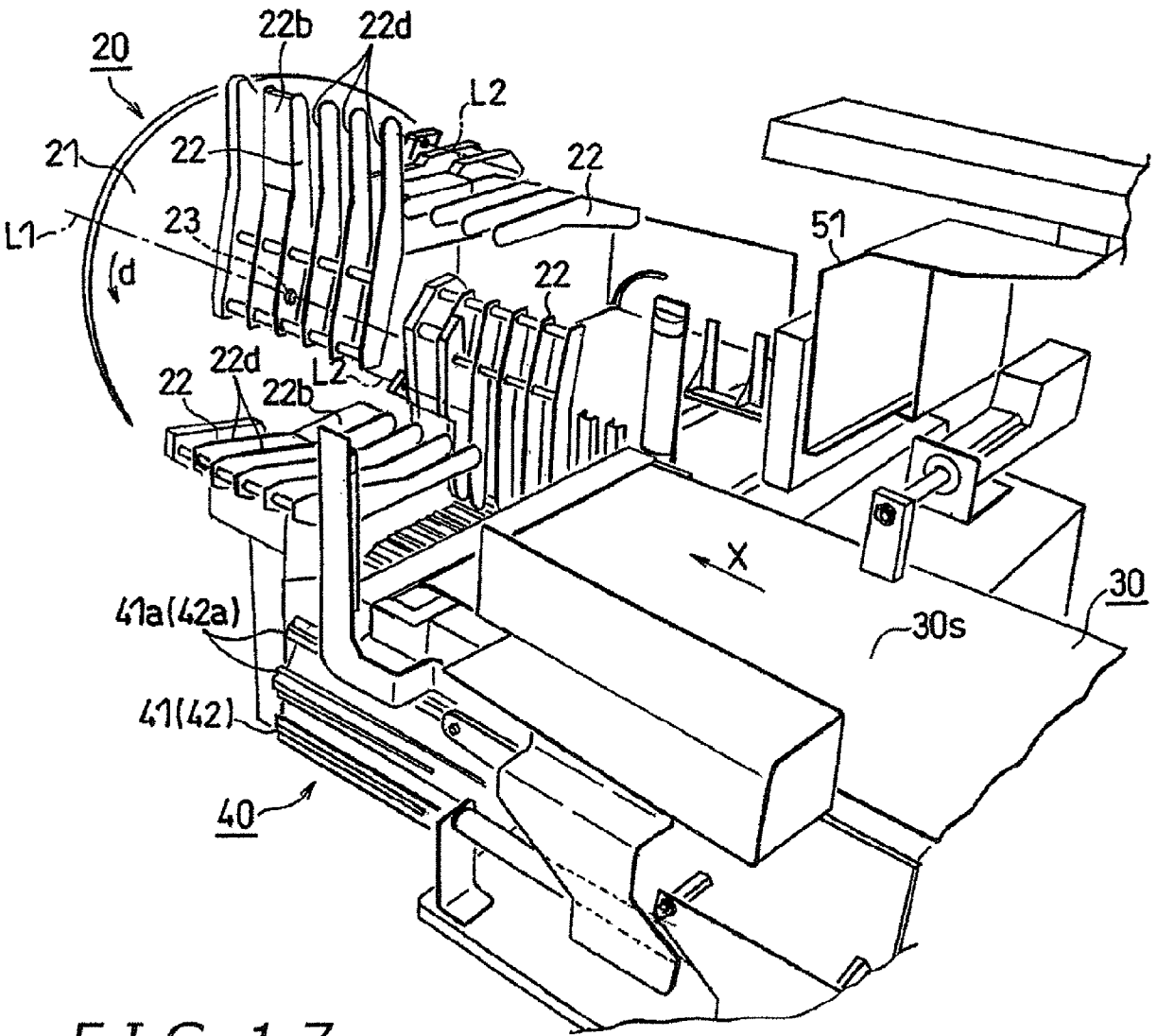
FIG. 17 is a schematic partial perspective view showing a telescopic conveyor and an orientation change mechanism of the accumulation device of the box packing system in accordance with the second embodiment of the present invention.
Figure 18:
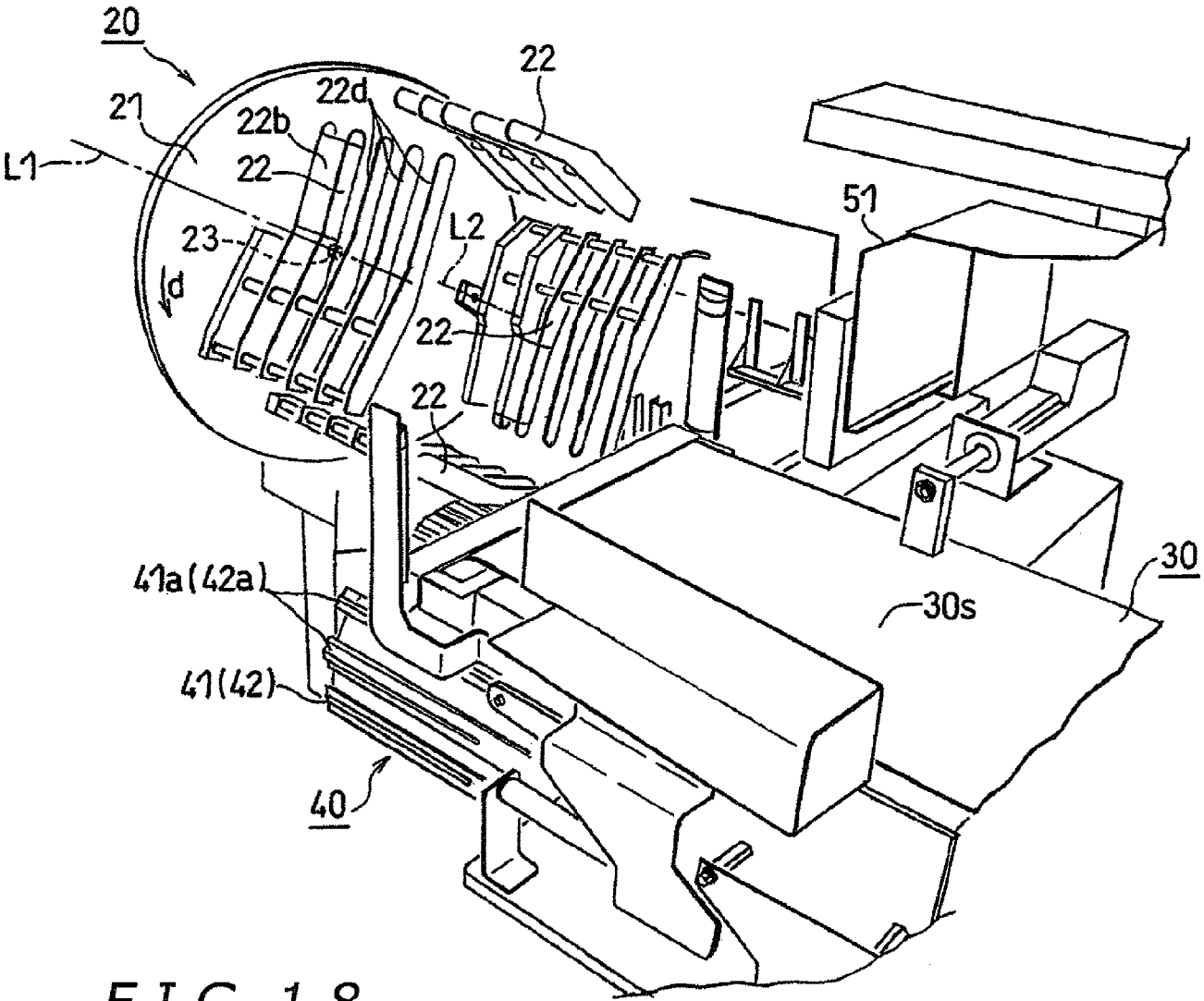
FIG. 18 is a schematic partial perspective view showing the telescopic conveyor and the orientation change mechanism of the accumulation device of the box packing system in accordance with the second embodiment of the present invention.
Figure 19:
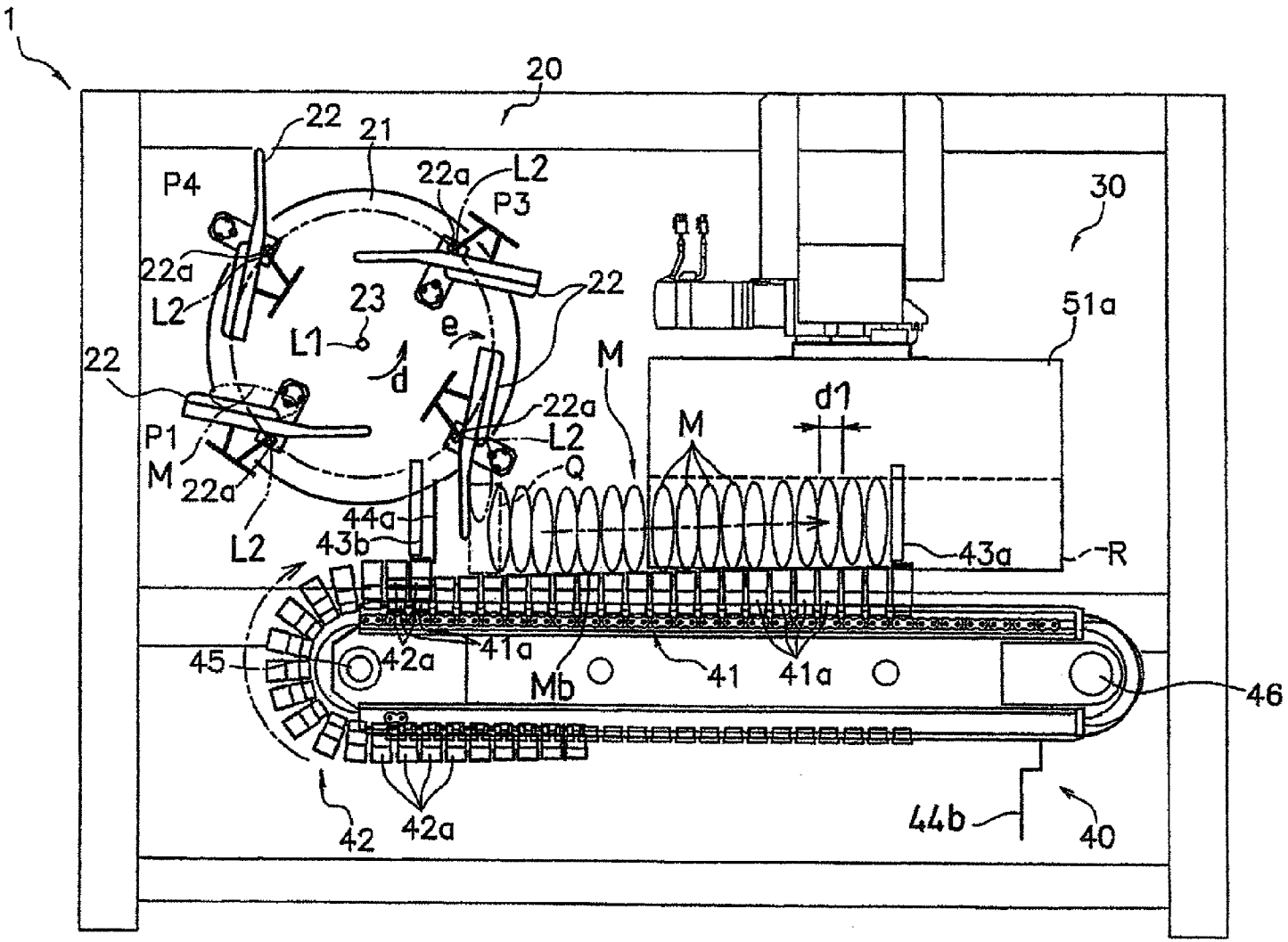
FIG. 19 is an upstream side elevational view of the accumulation device of the box packing system in accordance with the second embodiment of the present invention.

FIGS. 17 and 18 are perspective views showing the orientation change mechanism 20, and FIG. 19 is a side view showing the orientation change mechanism 20. The orientation change mechanism 20 is disposed directly downstream of the telescopic conveyor 30. The orientation change mechanism 20 receives products M that are transported downstream along the first direction X from the upstream telescopic conveyor 30, and sequentially arranges the products M in an upright orientation in a prescribed downstream position.

Figure 20:
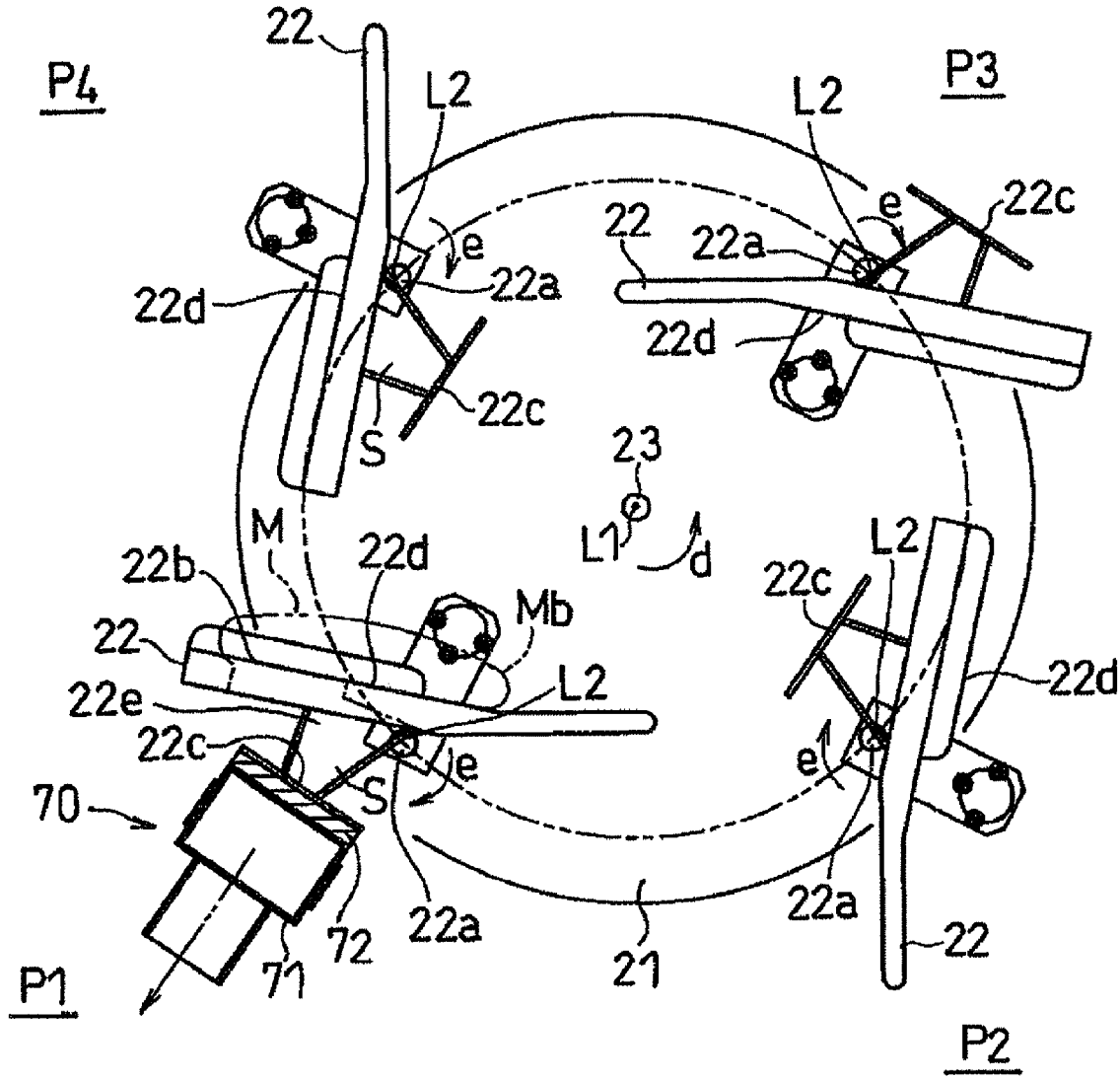
FIG. 20 is an enlarged side elevational view of the orientation change mechanism of the accumulation device in accordance with the second embodiment of the present invention.

The orientation change mechanism 20 specifically has a support plate 21, four transfer platforms 22, a first rotation shaft 23, and a suction device 70 (see FIG. 20).

The support plate 21 is a substantially circular plate that is supported by the first rotation shaft 23 so as to be able to rotate, and can rotate about a first rotational axis L1 at the center of the rotation shaft 23. The support plate 21 is mounted downstream of the telescopic conveyor 30 in alignment with a surface that is orthogonal to the first direction X (FIGS. 17 and 18).

The four transfer platforms 22 are mounted to the surface of the substantially circular support plate 21 directly downstream of the conveying device 10 (directly downstream of the telescopic conveyor 30). Specifically, the four transfer platforms 22 are each disposed on the same circle around the rotation shaft 23, and each have a comb-shaped loading surface 22*d* (FIG. 19). The detailed structure and operation of the transfer platforms 22 will be described hereinafter.

As shown in FIG. 20, the rotation shaft 23 is provided at the center of the substantially circular support plate 21, and is the center of the rotational path of the four transfer platforms 22. The rotation shaft 23 also moves the four transfer platforms 22 at a greater acceleration than the acceleration due to gravity g.

The suction device 70 is disposed in the vicinity of the rotational path of the four transfer platforms 22, in a prescribed position P1 outside the rotational path. The suction device 70 approaches a chamber part 22*e* of the transfer platforms 22 described hereinafter and draws the products M loaded on the transfer platforms 22 onto the loading surface 22*d*. The detailed structure of the suction device 70 will be described hereinafter.

Structure of Transfer Platforms 22

Each transfer platform 22 has a rotation shaft 22*a*, a loading surface 22*d*, and a chamber part 22*e*. A first opening 22*b* and a second opening 22*c* are also provided to the transfer platforms 22.

The rotation shafts 22*a* are rotation shafts for switching the orientation of the transfer platforms 22, and support the transfer platforms 22 so as to be able to rotate. The rotation shafts 22*a* are each attached to the support plate 21, and can rotate about a second rotational axis L2 that is parallel to the first rotational axis L1 shown in FIG. 17. The transfer platforms 22 rotate about the rotation shafts 22*a*, whereby the orientation of the products M received from the conveying device 10 (FIG. 14) is switched from the horizontal orientation to the upright orientation.

The loading surfaces 22*d* are surfaces that contact the products M, onto which the products M transported in from the conveying device 10 (FIG. 14) are loaded.

The chamber parts 22*e* are disposed on the opposite surface from the loading surfaces 22*d*. A negative pressure can be generated in the internal spaces S (FIG. 20) of the chamber parts 22*e*.

The first opening 22*b* is composed of a plurality of circular holes and is formed in a portion (not including the comb-shaped portion) of a metal plate in the loading surfaces 22*d* on which the products M are loaded (FIGS. 15B and 16B). The first opening 22*b* leads into the internal space S of the chamber part 22*e* from the loading surface 22*d*. A product M can thereby be drawn to the loading surface 22*d* by generating a negative pressure in the internal space S (FIG. 20) of the chamber part 22*e*.

A second opening 22*c* composed of a plurality of circular holes is formed in the distal end portion of the chamber part 22*e* on the opposite side from the loading surface 22*d*. The second opening 22*c* is therefore linked to the first opening 22*b* via the internal space S.

When a transfer platform 22 is in the position P1 during the process in which the transfer platforms 22 move along the rotational path about the rotation shaft 23, the distal end portion of the chamber part 22*e* makes contact with an elastic member 72 of the suction device 70 described hereinafter. Vacuum suction in the internal space S of the chamber part 22*e* is thereby created by the suction device 70 via the second opening 22*c*. A negative pressure can thereby be created in the internal space S.

Operation of Transfer Platforms 22

The transfer platforms 22 rotate about the rotation shaft 23 in conjunction with the rotation of the support plate 21. In the position P1 shown in FIG. 20, the transfer platforms 22 receive the horizontally oriented products M transported from the upstream conveying device 10 without changing the orientation thereof (see FIG. 14). At this time, the products M thus received are retained in the state of being drawn to the loading surface 22*d* of the transfer platform 22 by the suction device 70.

The support plate 21 then rotates approximately 90° in the rotation direction "d" about the rotation shaft 23, and the transfer platform 22 moves from position P1 to position P2. While the transfer platform 22 is moving from position P1 to position P2, the transfer platform 22 rotates approximately 90° in the rotation direction "e" about the rotation shaft 22*a* so that the product M is in the upright orientation.

The transfer platforms 22 load the products M in the upright orientation in the prescribed position Q in the transport mechanism 40 shown in FIG. 19. The transfer platforms 22 then retreat by moving upward (in direction "d") while rotating in the direction of the arrow e about the rotation shaft 23 so as not to touch the products M. At this time, any one of the buckets 41, 42 (described in detail hereinafter) is stopped in the prescribed position Q, and the products M are received and aligned so as to remain in the upright orientation.

Furthermore, the support plate 21 rotates approximately 90° in the rotation direction "d" about the rotation shaft 23, and the transfer platform 22 is moved from position P2 to position P3. The transfer platform 22 rotates approximately 90° in the rotation direction "e" about the rotation shaft 22*a* while moving from position P2 to position P3. The transfer platform 22 moves back to position P1 in the same manner after moving from position P3 to position P4.

The four transfer platforms 22 disposed beside the support plate 21 sequentially perform the operations described above, whereby the plurality of products M is loaded in sequence in the upright orientation in the prescribed position Q, and a bundle of aligned products M is formed.

Structure and Operation of Suction Device 70

The suction device 70 is a device for applying suction to the products M loaded on the transfer platforms 22 so as to draw the products M to the transfer platforms 22, and has a main body 71 and an elastic member 72.

The main body 71 is connected to a vacuum pump via an air duct (not shown). The vacuum pump is driven, whereby vacuum suction is created in the internal space of the main body 71, and a negative pressure is generated in the internal space.

The elastic member 72 is attached to the main body 71 on the side of the rotational path of the transfer platforms 22. A hole having substantially the same size as the second opening 22*c* is provided to the elastic member 72.

The elastic member 72 is disposed substantially parallel to the direction of a line tangent to the rotational path of the transfer platforms 22. Therefore, in the position P1 at which a transfer platform 22 receives a product M from the conveying device 10, the elastic member 72 and the distal end portion of the chamber part 22*e* come in contact with each other, and the internal space S of the chamber part 22*e* is evacuated. A negative pressure is thus created in the internal space S.

A rubber product, foam urethane, or another resin product may be used as the elastic member 72.

Structure and Operation of Transport Mechanism 40

Figure 21:
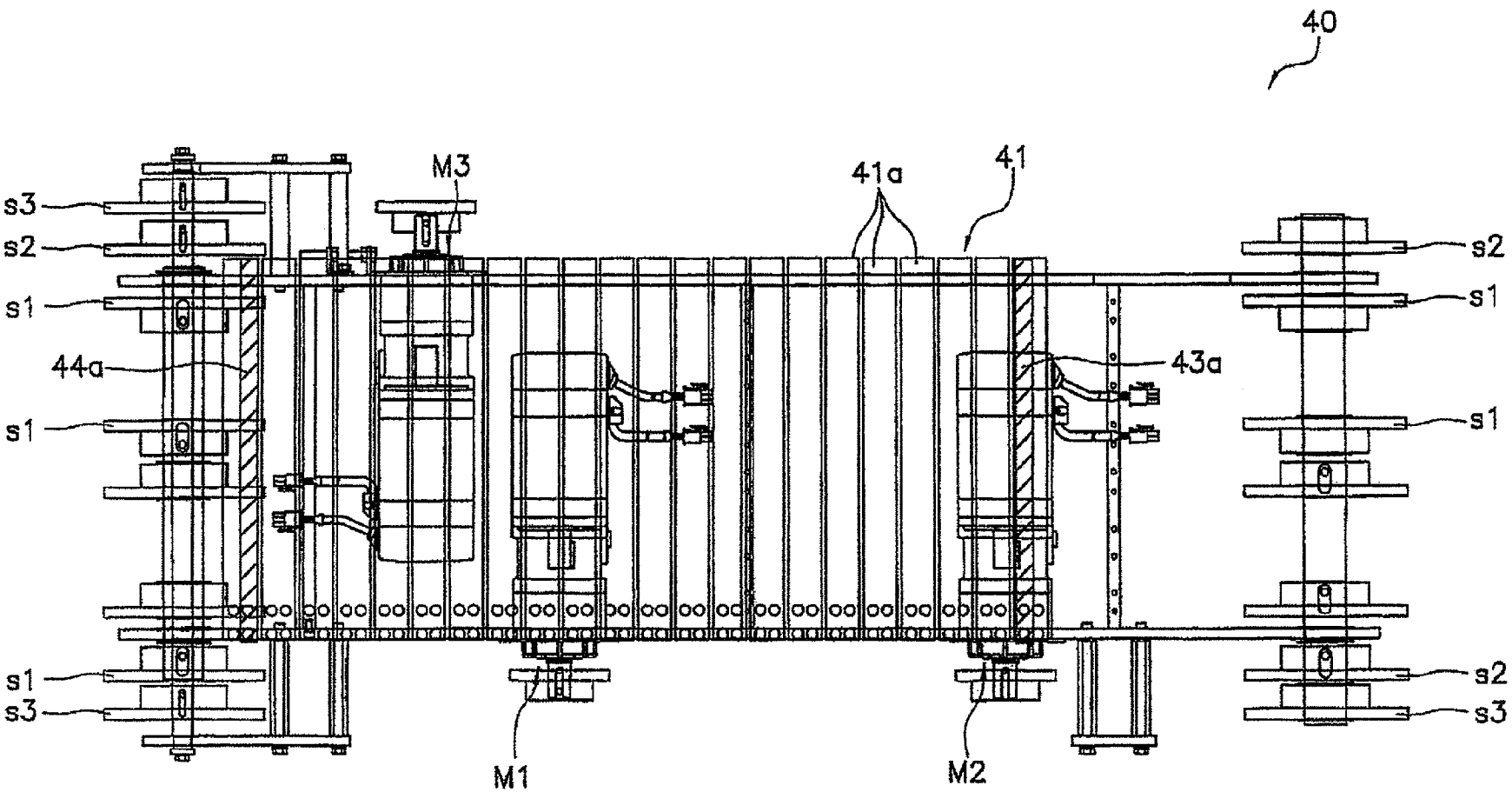
FIG. 21 is a top plan view of a transport mechanism of the accumulation device in accordance with the second embodiment of the present invention.
Figure 22:
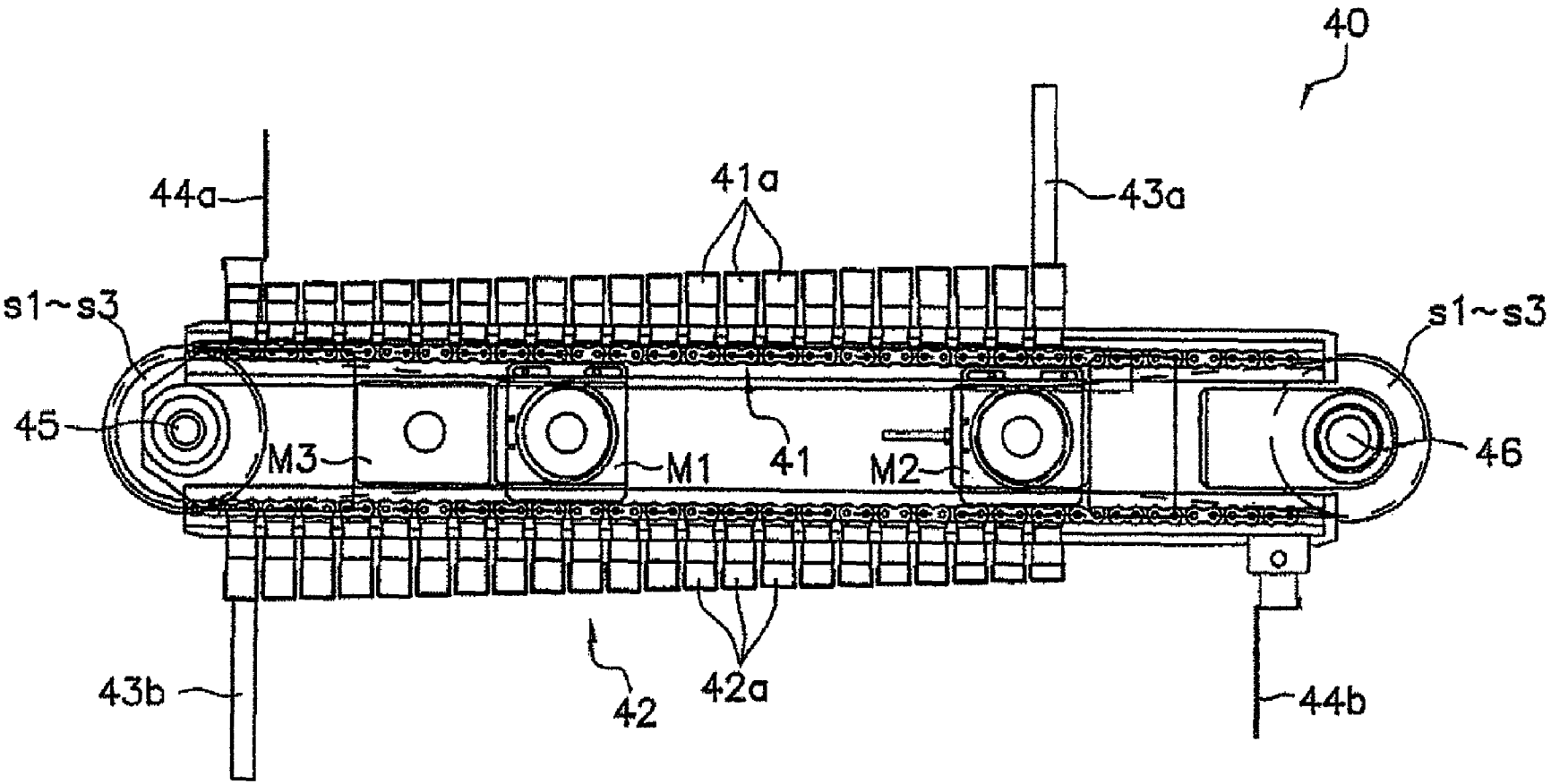
FIG. 22 is a side elevational view of the transport mechanism illustrated in FIG. 21 in accordance with the second embodiment of the present invention.

FIGS. 21 and 22 are a top view and a side view, respectively, showing the transport mechanism 40. The transport mechanism 40 has a plurality of buckets 41, 42, dividing panels 43*a*, 43*b*, back panels 44*a*, 44*b*, and drive motors M1 through M3. The transport mechanism 40 sequentially receives the products M transported from the upstream orientation change mechanism 20 in the upright orientation at the prescribed position Q, and transports a prescribed number of products M at a time to the downstream position R.

In FIG. 22, the buckets 41, 42 are disposed one each upstream and downstream, respectively, of the transport mechanism 40. The bucket 41 travels in a loop along a chain that is extended between sprockets s1, s1 that rotate about a rotation shaft 45, 46. The bucket 42 travels in a loop along a chain that is extended between sprockets s2, s2 that rotate about a rotation shaft 45, 46.

The buckets 41, 42 are combined with a plurality of bottom panels 41*a*, 42*a*, respectively, and the bottom panels 41*a*, 42*a* form support surfaces for supporting the bottom surfaces Mb of the products M.

A product row ML composed of a bundle of a plurality of products M is loaded onto the buckets 41, 42. The buckets 41, 42 transport the product row ML from the prescribed upstream position P to the downstream position R.

The dividing panels 43*a*, 43*b* are attached to the bottom panels 41*a*, 42*a* that are disposed furthest downstream (toward the leading end) among the plurality of bottom panels 41*a*, 42*a*, respectively. The dividing panels 43*a*, 43*b* retain the leading-end product M in the upright orientation in the product row ML transferred from a transfer platform 22. The sequentially transferred plurality of products M can thereby be aligned on the buckets 41, 42 after the leading-end product M is received.

The dividing panel 43*a* is driven by a drive motor M1 (FIG. 21) described hereinafter via the sprocket s1. The dividing panel 43*b* is driven by a drive motor M2 (FIG. 21) described hereinafter via the sprocket s2. The dividing panels 43*a*, 43*b* are separately driven. Furthermore, as shown in FIG. 15, the surfaces of the dividing panels 43*a*, 43*b* that come in contact with the products M are comb-shaped, and are formed so as to be able to meet and part with the comb-shaped portions of the aforementioned transfer platforms 22 without touching.

The back panels 44*a*, 44*b* shown in FIG. 19 are members for supporting the product row ML loaded onto the buckets 41, 42 from behind, and are provided one each to the dividing panels 43*a*, 43*b*, respectively. The back panels 44*a*, 44*b* are driven by a drive motor M3 (FIG. 21) that is a shared drive source, and are attached so as to face each other in the moving loop. The back panels 44*a*, 44*b* are thus driven by a drive source that is separate from that of the dividing panels 43*a*, 43*b*. The product row ML can therefore be held between the dividing panels 43*a*, 43*b*, and the product row ML can be stably transported to the discharge position R even when the number of the prescribed number of products M to be boxed is changed. The aspect whereby the surfaces of the back panels 44*a*, 44*b* that come in contact with the products M are comb-shaped, and are formed so as to be able to meet and part with the comb-shaped portions of the abovementioned transfer platforms 22 without touching each other is the same as in the dividing panels 43*a*, 43*b*.

The sprockets s1 through s3 shown in FIG. 21 have the same diameter and are disposed at both end portions in the transport mechanism 40. The dividing panel 43*a*, the dividing panel 43*b*, and the back panels 44*a*, 44*b* can thereby be moved at the same speed and at the same rotational speed.

In the second embodiment as described above, a configuration is adopted whereby the dividing panel 43*a*, the dividing panel 43*b*, and the back panels 44*a*, 44*b* are each independently driven; a first loop is formed by the drive motor M1 that drives the dividing panel 43*a*; a second loop is formed by the drive motor M2 that drives the dividing panel 43*b*; and a third loop is formed by the drive motor M3 that drives the back panels 44*a*, 44*b*.

Each product row ML is transported so as to be held between the dividing panel 43*a* and the back panels 44*a*, and between the dividing panel 43*b* and the back panel 44*b*, whereby the products can be transported in the transport mechanism 40 with significantly greater stability than in the conventional technique.

The method for transporting a product row ML using the transport mechanism 40 will be specifically described below using the bucket 41 as an example. Transport in the other bucket 42 is performed in the same manner as described below.

Figure 23A:
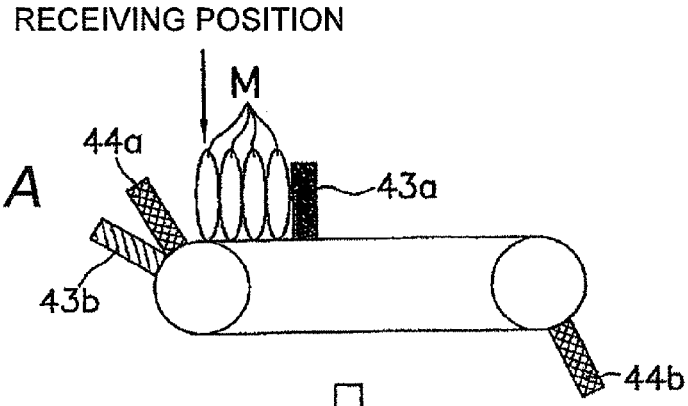
FIG. 23A is a schematic operation diagram showing a product accumulation method utilized in the accumulation device in accordance with the second embodiment of the present invention.
Figure 23B:
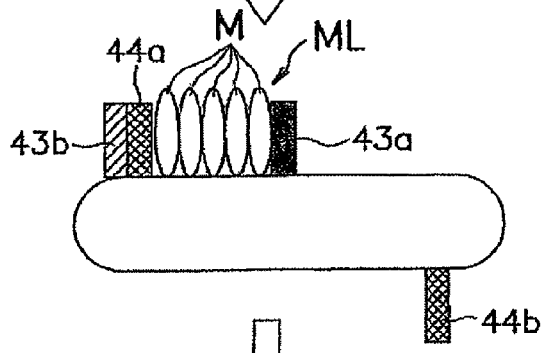
FIG. 23B is a schematic operation diagram showing a product accumulation method utilized in the accumulation device in accordance with the second embodiment of the present invention.
Figure 23C:
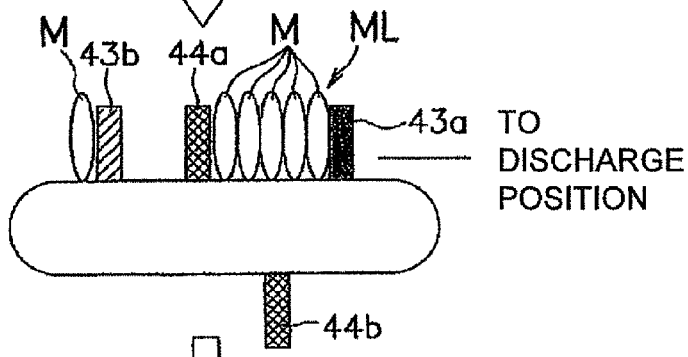
FIG. 23C is a schematic operation diagram showing a product accumulation method utilized in the accumulation device in accordance with the second embodiment of the present invention.
Figure 23D:
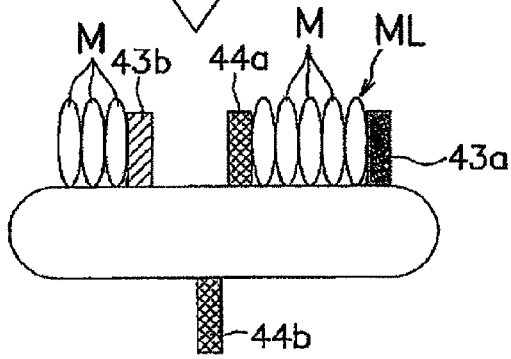
FIG. 23D is a schematic operation diagram showing a product accumulation method utilized in the accumulation device in accordance with the second embodiment of the present invention.

Specifically, the bucket 41 in FIG. 19, which is standing by in the prescribed position Q to which the products M are transferred, receives the product M at the leading end while the product M is retained in the upright orientation by the dividing panel 43*a* when the products M are transported from the upstream transfer platforms 22. The bucket 41 moves downstream a prescribed interval that corresponds to the thickness d1 (FIG. 19) of the bags of the products M, whereby the plurality of products M are received in an aligned state behind the product M that is received at the leading end, as shown in FIG. 23A. At this time, the back panel 44*a* stands by downstream of the prescribed position Q (see FIG. 24) in which the products M are received. The dividing panel 43*b* that corresponds to the downstream bucket 42 stands by immediately downstream of the back panel 44*a*. As shown in FIG. 23B, when a prescribed number of products have eventually been transferred into the product row ML, the product row ML held between the dividing panel 43*a* and the back panel 44*a* as shown in FIG. 23C is transported to the downstream discharge position R (see FIG. 24) in the second direction Y, as shown in FIG. 23D. At this time, the dividing panel 43*b* that was standing by immediately downstream in the second direction Y of the back panel 44*a* rapidly moves downstream of the back panel 44*a* and receives products M of the next batch from the transfer platforms 22, as shown in FIG. 23B.

Structure and Operation of Product Row Transporting Device 2

Figure 24:
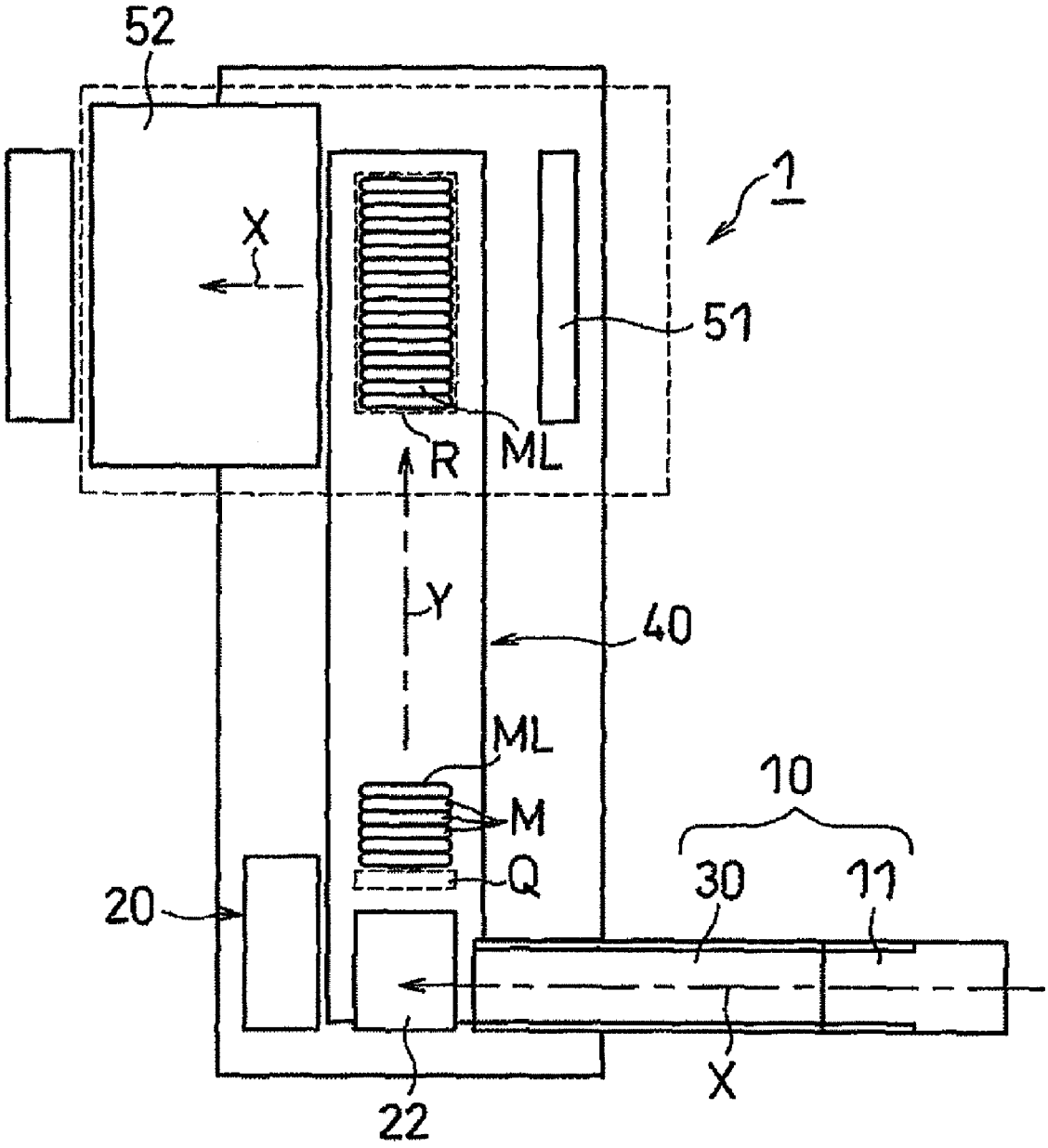
FIG. 24 is a schematic top plan view of the accumulation device in accordance with the second embodiment of the present invention.

The product row ML that has been aligned for a prescribed number of bags by the transport mechanism 40 shown in FIG. 24 is pushed onto a lifter 52 by a first pusher 51 of a discharge device 50. As shown in FIG. 14, the product row ML on the lifter 52 is raised in the vertical upward direction Z1, then pushed out in the first direction X by a second pusher 54 and transported onto a transport surface 65 of the product row transporting device 2 shown in FIG. 13.

The lifting and lowering pusher 61 indicated by the chain double-dashed line in FIG. 14 then pushes the product row ML in the first direction X. In this arrangement, a guide panel 80 is provided on both sides in the second direction (width direction) Y of the transport surface 65 of the product row transporting device 2 shown in FIG. 13. At this time, a linear continuous bar 91 (FIG. 14) is retained in an upright state in the second direction Y, whereby the rear end part of the product row ML in which the main surfaces Ms are guided by the guide panel 80 is pushed by the lifting and lowering pusher 61 against the bar 91 (FIG. 14), and the products M are aligned in a single row.

After alignment, the bar 91 (FIG. 14) collapses, and the product row ML is transported onto the shutter 62.

After transport, the shutter 62 opens, and the product row ML is loaded onto the raised lifting platform 63 indicated by the chain double-dashed line, after which the lifting platform 63 is lowered in the vertical downward direction Z2. A box B is set so that the opening Bu faces horizontally. After the product row ML is layered on the lifting platform 63, the lifting platform 63 is lowered to a position at which the lower opening Bu of the box B is at substantially the same level as the product row ML. After lowering, the product row ML is pushed into the box B and packed by the box-packing pusher 64.

The box B for which packing is completed is rotated so that the opening Bu faces upward.

Modified Examples of Second Embodiment

FIGS. 25A to 25C show modified examples of the accumulation device 1 according to the second embodiment described above. As shown in FIGS. 25A and 25B, in this modified example, the length of the telescopic conveyor 30 is constant, and the telescopic conveyor 30 is moved in the first direction X according to the size of the products M.

As shown in FIG. 25A, the telescopic conveyor 30 is moved toward the orientation change mechanism 20 when the products M are small. As shown in FIG. 25B, the upstream end of the telescopic conveyor 30 is moved below the induction conveyor 11, and the telescopic conveyor 30 is moved away from the orientation change mechanism 20 when the products M are large.

Other structural aspects are the same as in the second embodiment, the same reference symbols are used for corresponding components and components that are the same, and detailed descriptions thereof are omitted.

The telescopic conveyor 30 may be moved using a motor (not shown) provided to a movement device 30A. In this case, a stepping motor or a pulse motor may be used as the motor to control the position of the telescopic conveyor 30. Specifically, a unit for storing the rotation angle of the motor (a rotation angle storage unit) is provided, as shown in FIG. 25C. The counter number of an encoder according to the size of the products M, i.e., the rotation angle of the motor, is set and stored in advance in the rotation angle storage unit. The counter number is read from the storage unit according to the size of the products M, and the position of the telescopic conveyor 30 is controlled based on the counter number.

As described above, preferred embodiments were described with reference to the drawings, but various changes and modifications within a self-evident range can easily be conceived of by one skilled in the art based on the basis of the present specification.

For example, an air cylinder was used in the telescopic conveyor 30 of the second embodiment to extend and retract the telescopic conveyor 30, but extension and retraction may be performed using a motor instead of an air cylinder, or the telescopic conveyor 30 may be manually extended and retracted according to the size of the product.

Moreover, it will be apparent to those skilled in the art from the disclosure of the present invention that the conveying device 110 of the first embodiment can be replaced with the conveying device 10 of the second embodiment to include the induction conveyor 11 and the telescopic conveyor 30 so that the length of the conveying device 110 in the first embodiment can be selectively extended and retracted according to the length of the products in the conveying direction as described in the second embodiment.

Such changes and modifications are accordingly construed to be within the range of the present invention as established by the claims.

The accumulation device of the present invention demonstrates effects whereby products can be efficiently accumulated according to a plurality of accumulation patterns in a single device, and the present invention can therefore be widely applied in various devices for accumulating products in a prescribed accumulation pattern, and then processing the products.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An accumulation device adapted to generate a bundle of a plurality of aligned products while transporting the products with each of the products having a pair of main surfaces and at least one connecting bottom part that connects the main surfaces, the accumulation device comprising:

a conveying unit having a transport surface configured and arranged to transport the products in a first direction while each of the products is oriented in a horizontal orientation so that one of the main surfaces is supported on the transport surface;

an orientation changing unit configured and arranged to receive the products from the conveying unit and to change an orientation of the products from the horizontal orientation to an upright orientation in which the main surfaces are aligned with the first direction and a vertical direction; and an aligning unit configured and arranged to accumulate the products in the upright orientation in a second direction that is perpendicular to the first direction so that the products are stacked with the main surfaces of an adjacent pair of the products contacting each other, the conveying unit being configured and arranged to selectively extend and retract in the first direction to change a distance between the conveying unit and the orientation changing unit according to a length of each of the products in the first direction.

2. The accumulation device according to claim 1, wherein the conveying unit is configured and arranged to selectively extend so that a distal end of the conveying unit approaches the orientation changing unit when the length of each of the products is short, and the conveying unit is configured and arranged to selectively retract so that the distal end of the conveying unit is spaced apart from the orientation changing unit when the length of each of the products is long.

3. The accumulation device according to claim 2, wherein the conveying unit is configured and arranged to selectively extend and retract so that a position of the distal end of the conveying unit is changed according to a size of a bag of each of the products.

4. The accumulation device according to claim 1, wherein the conveying unit includes an annular conveyor belt that forms the transport surface, a first moving roller that is in contact with an internal peripheral surface of the conveyor belt, and is disposed at a downstream end portion of the conveying unit in the first direction, a first fixed roller that is in contact with the internal peripheral surface of the conveyor belt, and is disposed at the downstream end portion of the conveying unit in the first direction, a second moving roller that is in contact with an external peripheral surface of the conveyor belt, and is disposed between the first moving roller and the first fixed roller, and a second fixed roller that is in contact with the internal peripheral surface of the conveyor belt, and is disposed at an upstream end portion of the conveying unit in the first direction.

5. The accumulation device according to claim 1, wherein the orientation changing unit includes a support plate configured and arranged to rotate about a first rotational axis that extends along the first direction, and at least one transfer platform configured and arranged to rotate about a second rotational axis that is parallel to the first rotational axis on the support plate, the transfer platform being configured and arranged to receive the products in the horizontal orientation and to change the orientation of the products to the upright orientation by rotating about the second rotational axis.

6. The accumulation device according to claim 5, wherein the conveying unit is configured and arranged to be placed in an extended state when the products are transferred to the transfer platform and in a retracted state while the orientation of the products are changed.

7. The accumulation device according to claim 1, wherein the aligning unit includes a support surface configured and arranged to support the bottom parts of the products, a dividing panel configured and arranged to contact with one of the main surfaces of one of the products disposed at a leading end of a row of the products, and a back panel configured and arranged to contact with one of the main surfaces of one of the products disposed at a trailing end of the row of the products.

* * * * *